US008013550B1

(12) United States Patent
Young et al.

(10) Patent No.: US 8,013,550 B1
(45) Date of Patent: Sep. 6, 2011

(54) MODEL TRAIN REMOTE CONTROL SYSTEM HAVING REALISTIC SPEED AND SPECIAL EFFECTS CONTROL

(75) Inventors: Neil Young, Woodside, CA (US); Louis G. Kovach, Belleville, MI (US)

(73) Assignee: Liontech Trains LLC, Chesterfield, MI (US)

( * ) Notice: Subject to any disclaimer, the term of this patent is extended or adjusted under 35 U.S.C. 154(b) by 860 days.

(21) Appl. No.: 11/779,864

(22) Filed: Jul. 18, 2007

Related U.S. Application Data

(63) Continuation-in-part of application No. 11/187,709, filed on Jul. 22, 2005, which is a continuation-in-part of application No. 10/723,460, filed on Nov. 26, 2003, now Pat. No. 7,312,590.

(51) Int. Cl.
*H02P 5/00* (2006.01)

(52) U.S. Cl. ..... 318/268; 318/255; 246/187 A; 246/187 R; 446/7; 446/410

(58) Field of Classification Search ..... 318/255, 318/268
See application file for complete search history.

(56) References Cited

U.S. PATENT DOCUMENTS

| | | | | | |
|---|---|---|---|---|---|
| 2,910,011 | A | | 10/1959 | Bonanno | |
| 3,307,058 | A | | 2/1967 | Karel | |
| 3,664,060 | A | * | 5/1972 | Longnecker | 446/410 |
| 3,860,237 | A | | 1/1975 | Cooper et al. | |
| 4,042,810 | A | | 8/1977 | Mosher | |
| 4,085,356 | A | | 4/1978 | Meinema | |
| 4,352,010 | A | | 9/1982 | Koogler | |
| 4,408,172 | A | | 10/1983 | Perdue | |
| 4,859,000 | A | | 8/1989 | Deno, Jr. | |
| 4,864,306 | A | | 9/1989 | Wiita | |
| 5,045,016 | A | | 9/1991 | Stern et al. | |
| 5,050,505 | A | | 9/1991 | Konno | |
| 5,251,856 | A | * | 10/1993 | Young et al. | 246/4 |
| 5,405,182 | A | | 4/1995 | Ewe | |
| 5,441,223 | A | | 8/1995 | Young et al. | |
| 5,456,604 | A | | 10/1995 | Olmsted et al. | |
| 5,480,333 | A | * | 1/1996 | Larson | 446/7 |
| 5,555,815 | A | * | 9/1996 | Young et al. | 104/296 |
| 5,749,547 | A | | 5/1998 | Young et al. | |
| 5,754,094 | A | | 5/1998 | Frushour | |
| 5,758,306 | A | | 5/1998 | Nakamura | |

(Continued)

OTHER PUBLICATIONS

ProCab Manual, Operation Manual, NCE Publications Department, Webster, New York, Version 1.3, pp. 1-15, Mar. 5, 2001.

(Continued)

*Primary Examiner* — Walter Benson
*Assistant Examiner* — Kawing Chan
(74) *Attorney, Agent, or Firm* — O'Melveny & Myers LLP

(57) ABSTRACT

The model train control system includes a remote control device that receives user input with respect to various train functions such as desired speed and effects, and that generates commands based on that input in order to cause the model train to perform in a desired manner. In an embodiment of the invention, the model train controller comprises control input devices that permit user control over corresponding control features of the model train. A touch screen display may be coupled to the housing and adapted to receive user selections regarding the control features. A processor is operatively coupled to the control input devices and the touch screen display. The processor is adapted to generate at least one model train command to be transmitted to the model train based at least in part on a user input received from either one of the control input devices or the touch screen display.

90 Claims, 11 Drawing Sheets

U.S. PATENT DOCUMENTS

| | | | | |
|---|---|---|---|---|
| 5,803,411 | A | 9/1998 | Ackerman et al. | |
| 5,896,017 | A | 4/1999 | Severson et al. | |
| 5,954,584 | A | 9/1999 | Yagi | |
| 5,994,853 | A | 11/1999 | Ribbe | |
| 6,179,105 | B1 | 1/2001 | Haass | |
| 6,190,279 | B1 | 2/2001 | Squires | |
| 6,246,950 | B1 | 6/2001 | Bessler et al. | |
| 6,255,798 | B1 | 7/2001 | Obara et al. | |
| 6,281,606 | B1 * | 8/2001 | Westlake | 307/125 |
| 6,385,522 | B1 | 5/2002 | Pugh | |
| 6,390,883 | B1 | 5/2002 | Choi | |
| 6,441,570 | B1 | 8/2002 | Grubba et al. | |
| 6,457,681 | B1 | 10/2002 | Wolf et al. | |
| 6,465,772 | B1 | 10/2002 | Nelson et al. | |
| 6,529,139 | B1 | 3/2003 | Behun et al. | |
| 6,534,948 | B2 | 3/2003 | Ohura et al. | |
| 6,536,716 | B1 * | 3/2003 | Ireland et al. | 246/187 A |
| 6,539,292 | B1 | 3/2003 | Ames | |
| 6,619,594 | B2 | 9/2003 | Wolf et al. | |
| 6,624,537 | B2 | 9/2003 | Westlake | |
| 6,655,640 | B2 | 12/2003 | Wolf et al. | |
| 6,662,917 | B1 | 12/2003 | Wolf et al. | |
| 6,686,911 | B1 * | 2/2004 | Levin et al. | 345/184 |
| 6,729,584 | B2 | 5/2004 | Ireland | |
| 6,747,579 | B1 | 6/2004 | Ireland | |
| 6,765,356 | B1 | 7/2004 | Denen et al. | |
| 6,828,747 | B2 | 12/2004 | Endo et al. | |
| 6,864,879 | B2 | 3/2005 | Nojima et al. | |
| 6,900,793 | B2 | 5/2005 | Goh et al. | |
| 6,908,066 | B2 * | 6/2005 | Koenig | 246/122 A |
| 6,956,558 | B1 | 10/2005 | Rosenberg et al. | |
| 7,038,667 | B1 * | 5/2006 | Vassallo et al. | 345/184 |
| 7,164,368 | B1 | 1/2007 | Ireland | |
| 7,312,590 | B1 * | 12/2007 | Kovach et al. | 318/268 |
| 7,771,319 | B1 * | 8/2010 | Spoeth et al. | 482/8 |
| 2001/0044686 | A1 | 11/2001 | Taniguchi et al. | |
| 2002/0046675 | A1 | 4/2002 | Young | |
| 2003/0015626 | A1 | 1/2003 | Wolf et al. | |
| 2003/0051631 | A1 * | 3/2003 | Ring | 105/1.5 |
| 2003/0103044 | A1 | 6/2003 | Sunda et al. | |
| 2003/0142796 | A1 | 7/2003 | Ames | |
| 2003/0211832 | A1 | 11/2003 | Inokoshi et al. | |
| 2004/0032395 | A1 | 2/2004 | Goldenberg et al. | |
| 2004/0056624 | A1 | 3/2004 | Hayasaka | |
| 2004/0079841 | A1 | 4/2004 | Wolf et al. | |
| 2004/0093196 | A1 | 5/2004 | Hawthorne et al. | |
| 2004/0239268 | A1 | 12/2004 | Grubba et al. | |
| 2005/0023416 | A1 | 2/2005 | Wolf et al. | |

OTHER PUBLICATIONS

Powerhouse™ CAB-04p, Intermediate Cab, Operation Manual, NCE Publications Department, Webster, New York, pp. 1-7, Mar. 4, 2001.

Panel Mount/PCB Mount/Right Angle (S) Type Datasheet for Part No. EC202AXXXA2XD, CUI, Inc., Datasheet, Beaverton, OR, Jul. 2, 2002, Rev. A, 1 Page.

Lionel® Electric Trains Trainmaster® Command, The Complete Guide to Command Control, Lionel Trains, Inc., 1995, pp. 1-48, Chesterfield, MI.

DCS (Digital Command System) Command System User's Guide, MTH Electric Trains, Columbia, MD, undated, version 2.2, pp. 1-5, 48-52 (Chapter 5: Menu Operations—Control).

* cited by examiner

| Event Type | Event Description |
|---|---|
| 3 | Stop at Station |
| 4 | Pass Through Station |
| 4 | Deliver Freight Car to Siding |
| 4 | Pick Up Freight Car from Siding |
| 5 | Sequential Lighting |

MODEL TRAIN REMOTE CONTROL SYSTEM HAVING REALISTIC SPEED AND SPECIAL EFFECTS CONTROL

CROSS-REFERENCES TO RELATED APPLICATIONS

This non-provisional patent application claims priority as a continuation-in-part pursuant to 35 U.S.C. §120 to patent application Ser. No. 11/187,709, filed Jul. 22, 2005, which in turn claims priority as a continuation-in-part pursuant to 35 U.S.C. §120 to patent application Ser. No. 10/723,460, filed Nov. 26, 2003 now U.S. Pat. No. 7,312,590, each of which are incorporated by reference herein for all purposes.

BACKGROUND OF THE INVENTION

The present invention relates to a model train control system. Conventional model train command control systems comprise a simple direction control and a throttle, along with a brake or boost feature. Command systems that send commands to specific engines or other accessories, tracks, trains, etc. are commonly known in the art. In addition, microprocessor based digital sound systems that playback recorded train sounds assembled by algorithms based on state and user input are commonly known in the art, as are smoke and lighting systems that attempt to model a train in motion. The present invention provides advantages in the area of model trains to achieve the goal of realism during operation.

A control and motor arrangement for a model train that simulates the effects of inertia is disclosed in U.S. Pat. No. 6,765,356 issued to Denen et al. The control arrangement is adapted to receive speed information from the motor and is configured and arranged to provide a control signal to the motor for controlling the speed of the motor. A command control interface receives commands from a command control unit. A process control arrangement is configured and arranged to control a rotational speed of the motor in response to rotational speed information received from the motor.

Slow speed operation without stalling the drive motor of a model train system is disclosed in U.S. Pat. No. 6,190,279 issued to Squires. A power transmission system enables a motor to start and continue to run while the locomotive is not moving. The power transmission system is located between the existing motor and the worm gearset of a standard model railroad locomotive eliminating the long standing problems of start-up motor stall and lunging movement during a slow, variable speed operation under load. Furthermore, U.S. Pat. No. 6,539,292 issued to Ames discloses a model train in which the back-EMF energy of the engine motor is monitored to give an indication of the load. Knowing the load, the power transmission system responds quickly to a minor variation of power or braking applied if there is a light load. A fully loaded train has more momentum and responds much slower. Adjustments can be made as a result of changes of load received due to the train climbing a grade.

In real trains, as opposed to model trains, adaptive brake control is used to vary the air pressure for the brakes for different cars in a train to control the braking. See, e.g., U.S. Pat. No. 4,859,000 issued to Deno et al. and U.S. Pat. No. 5,405,182 issued to Ewe et al. A system for braking an engine in a model train is shown in U.S. Pat. No. 4,085,356 issued to Meinema.

U.S. Pat. No. 5,480,333 issued to Larson discloses a locomotive control simulator assembly for a model train controller where train speed is controlled by rotation of a protruding shaft. A realistic throttle or speed control for a model train is used by a model train user to regulate the starting, acceleration, running speed and deceleration of a model train. The model train controller has sliding actuators for switches regulating conditions of operation, such as direction, braking, and/or momentum. U.S. Pat. No. 4,085,356 issued to Meinema shows a capacitor connected to the motor control circuit of a model train locomotive for controlling the rate of deceleration.

U.S. Pat. Nos. 5,441,223 and 5,749,547 issued to Young et al. show a variety of mechanisms used to control the velocity of model trains and are incorporated by reference herein for all purposes. Conventionally, power may be applied by a transformer to a track, where the power is increased as a knob is turned in the clockwise direction, and decreased as a knob is turned in the counter-clockwise direction. In another type of control system, a coded signal is sent along the track, and addressed to the desired train, conveying a speed and direction. The train itself controls its speed, by converting the AC voltage on the track into the desired AC or DC motor voltage for the train according to the received instructions. Furthermore, commands such as signals instructing the train to activate or deactivate its lights, or to sound its horn, can be controlled. Due to this increase in complexity of model railroading layouts and equipment, it is desired to exercise more precise control over the velocity of locomotives. NCE Corporation of Webster, N.Y., has introduced into its model railroad controllers, the velocity control mechanism known as "ballistic tracking." According to this ballistic tracking scheme, the faster a control knob is turned, the larger a single velocity command speed change will be issued to the train.

Despite the foregoing advancements, it remains of continuing interest in the art to improve the realism of model train control, particularly with respect to the control over speed and the generation of special effects.

BRIEF SUMMARY OF THE INVENTION

The present invention provides a model train control system that enables a greater degree of control over the model train. The model train control system includes a remote control device that receives user input with respect to various train functions such as desired speed and effects, and that generates commands based on that input as well as other information in order to cause the model train perform in a desired manner. Unlike prior systems in which the remote control simply relays commands to the model train, the remote control of the present invention actively interprets the user's input to generate commands that are predictive of desired train behavior. This results in model train operation that is more realistic, easy to use, and enjoyable for the user.

In an embodiment of the invention, a model train controller comprises a plurality of control input devices that permit user control over corresponding plural control features of the model train. A touch screen display may be coupled to the housing and adapted to display information concerning at least one of the plural control features of the model train and receive user selections regarding the at least one control feature. A processor is operatively coupled to the plurality of control input devices and the touch screen display. The processor is adapted to generate at least one model train command to be transmitted to the model train based at least in part on a user input received from either one of the plurality of control input devices or the touch screen display. A transmitter is adapted to communicate the at least one model train command to the train. The model train command causes performance of one of the plural control features of the train in a manner corresponding to the received user input.

More particularly, the plurality of control input devices may include a user throttle input for selecting a target speed for the model train. The processor determines a commanded speed based at least in part on the selected target speed and generates the model train command including the commanded speed. The plurality of control input devices may also include a momentum input for selecting a momentum level for the model train. The momentum level defines a rate in which the commanded speed is changed by the processor to match the target speed. The processor determines the commanded speed based in part on a selected momentum level for the train. The plurality of control input devices may also include a brake input for selecting a braking level for the model train. The processor determines the commanded speed based on the braking level such that the commanded speed is reduced by an amount corresponding to the braking level. The plurality of control input devices may also include an effects input device for controlling production of at least one effect. The processor generates the model train command to cause the model train to produce the at least one effect responsive to user operation of the effects input device. The effect may include a sound effect, a smoke effect, or an action effect.

In another embodiment of the invention, a model train controller comprises at least one sound effects input device for controlling production by a model train of at least one sound effect. The at least one sound effects input device further comprises a linear slider biased in a neutral position such that selective movement of the slider away from the neutral position produces the at least one sound effect having a characteristic corresponding to an extent of movement away from the neutral position. A processor is operatively coupled to the sound effects input device. The processor is adapted to generate at least one model train command to be transmitted to the model train based at least in part on a user input received from the sound effects input device. The model train command causes the model train to produce the sound effect responsive to user operation of the sound effects input device. A transmitter is adapted to communicate the model train command to the train.

More particularly, the neutral position of the sound effects input slider may be disposed substantially in a center of travel of the linear slider. Selective movement of the slider in a first direction away from the neutral position produces a first effect and selective movement of the slider in a second direction away from the neutral position produces a second effect different than the first effect. The at least one effect may comprise a horn sound effect and the characteristic comprises intensity of the horn sound. Alternatively, the at least one effect may comprise at least one horn sound effect and the characteristic comprises number of distinctive horn sounds. In another alternative, the at least one effect comprises at least one bell sound effect and the sound characteristic comprises number of distinctive bell sounds or intensity of the at least one bell sound.

In another embodiment of the invention, a model train controller comprises a user throttle input device adapted for user selection of a target speed for the model train, and a brake input device adapted for user selection of a braking effect for the model train. A processor is operatively coupled to the user throttle input device and the brake input device. The processor determines a commanded speed based on at least one of the target speed and the braking effect. The processor further determines a sound effect based on at least one of the target speed and the braking effect. The processor is adapted to generate at least one model train command to be transmitted to the model train that includes at least one of the commanded speed and the sound effect. A transmitter is adapted to communicate the model train command to the train.

More particularly, the processor may determine the commanded speed by reducing the target speed by an amount corresponding to the braking effect. The brake input device may further comprise a linear slider biased in a neutral position such that selective movement of the slider away from the neutral position produces the braking effect having a characteristic corresponding to an extent of movement away from the neutral position. The characteristic may comprise intensity of the sound effect or an amount of speed reduction. Alternatively, the characteristic may comprise a braking sound effect for a first portion of the extent of movement away from the neutral position, and a combination of the braking sound effect and a reduction in the commanded speed for a second portion of the extent of movement away from the neutral position.

In yet another embodiment of the invention, a model train controller comprises a plurality of control input devices permitting user control over corresponding plural control features of the model train, a processor operatively coupled to the plurality of control input devices and adapted to generate a series of successive model train commands to be transmitted to the model train based at least in part on a single user input received from one of the plurality of control input devices. A transmitter is adapted to communicate the successive model train commands to the train, wherein the series of successive model train commands causes performance of corresponding control features of said train. The plurality of control input devices may include a user throttle input for selecting a target speed for the model train. The processor determines a commanded speed based at least in part on the selected target speed, so that at least one of the successive model train commands includes the commanded speed. The plurality of control input devices may also include a momentum input for selecting a momentum level for the model train. The processor determines the commanded speed based on a selected momentum level for the train such that the momentum level defines a rate in which the commanded speed is changed by the processor in the successive model train commands to match the target speed. The plurality of control input devices may also include a brake input for selecting a braking level for the model train. The processor determines the commanded speed based on the braking level such that the commanded speed is reduced by the processor over the successive model train commands by an amount corresponding to the braking level. The plurality of control input devices may also include an effects input device for controlling production of at least one effect in which at least one of the successive model train commands causes the model train to produce the at least one effect. The effect may include a sound effect, a smoke effect, and/or an action effect.

In yet another embodiment of the invention, a model train controller comprises a housing, a touch screen display coupled to the housing and adapted to display icons corresponding to operable features of a model train layout, at least one user input device coupled to the housing and permitting user control over the operable features of the model train layout, and a processor disposed within the housing and operably coupled to the touch screen display and the at least one user input device. The processor generates at least one digital command based on user settings of the at least one user input device and user selections on the touch screen display. A transmitter is adapted to communicate the at least one digital command to the operable features of a model train layout.

A more complete understanding of the model train control system will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE INVENTION

System

Figure 1:
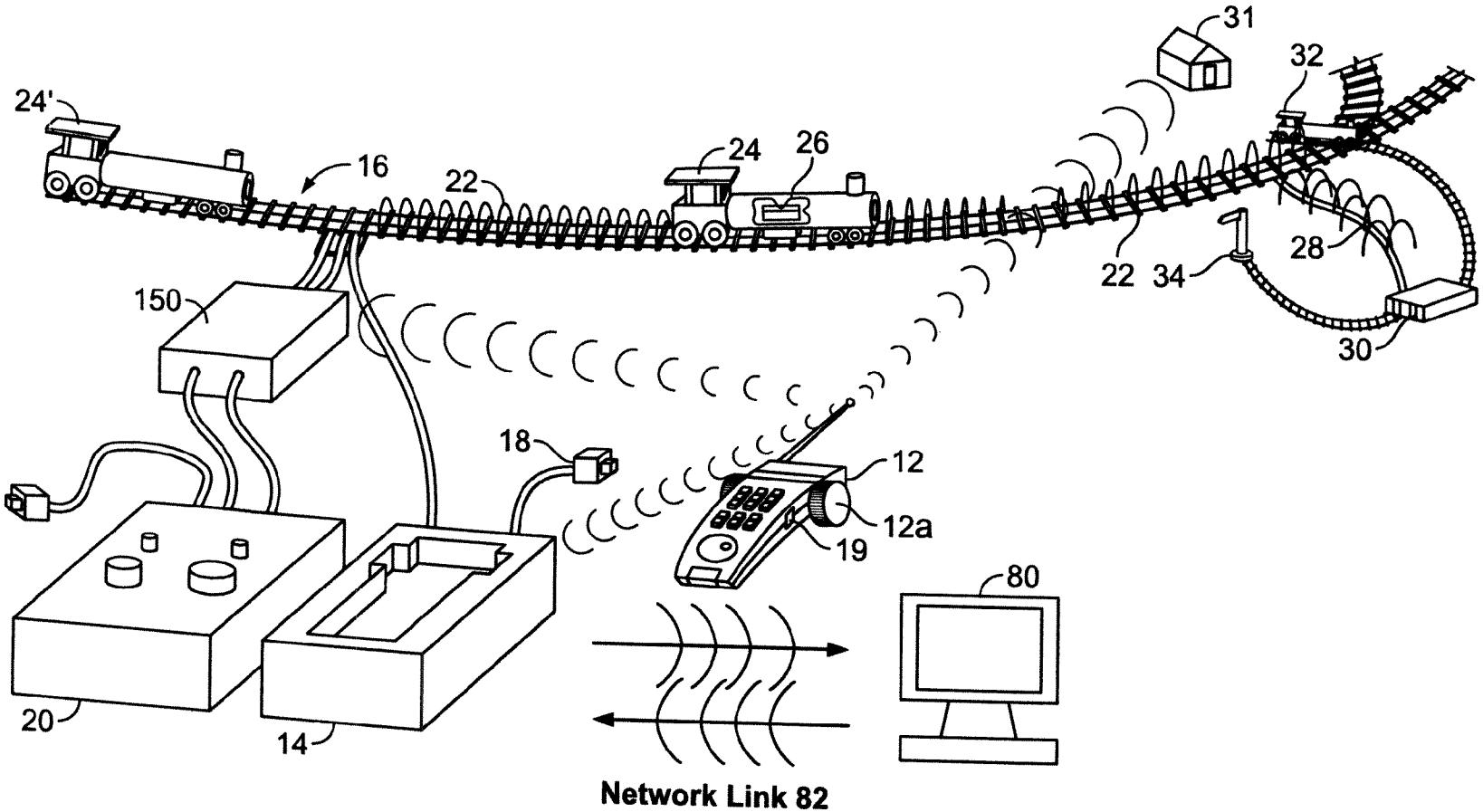
FIG. 1 is a perspective drawing of an exemplary embodiment of a model train layout of a model train track system in accordance with an embodiment of the present invention.

FIG. 1 is a perspective drawing of an exemplary embodiment of a sample model train layout of a model train track system in accordance with the present invention. A hand-held remote control unit 12 including control input apparatus 12*a* is used to transmit and receive signals to and from a central control module 14, model locomotive 24, and trackside accessory 31. A power signal is created between the rails of the track by power supply 20 or by central control module 14. Central control module 14 can superimpose control signals on the track power signal. Locomotive 24 is configured to receive, decode, and respond to superimposed signals over train track 16.

Central control module 14 is equipped to receive and transmit RF signals, also known as RF control commands. RF control commands can originate from the central control module 14, the remote control unit 12, the trackside accessory 31, or the locomotive 24. RF control commands received by central control module 14 may then be processed therein. According to one embodiment of the present invention, the central control module 14 may superimpose commands along track 16. Locomotive 24 or trackside accessory 31 may receive the superimposed signals and react accordingly. Locomotive 24 can also be equipped to transmit and receive RF signals directly to/from the remote control unit 12, the central control module 14, the trackside accessory 31, other locomotives, switch controller 30, and other layout objects. In accordance with another embodiment of the present invention, the remote control unit 12 may communicate with locomotive 24 through a direct wireless communication link. In an alternative embodiment of the present invention, remote control unit 12 may communicate bi-directionally with the locomotive 24 via a direct wireless communication link, such as an RF wireless communication link. For example, the 900 Mhz band could be used, or 2.4 Ghz. Alternatively, two separate channels could be used in the same band, with one channel used to communicate with the remote control and the second channel used to communicate directly to the train. This would provide advantages in terms of increased bandwidth and minimal delays to command transmission instead of data gathering.

The superimposed signal generated by the central control module 14 can propagate along track 16. The switch controller 30 and the trackside accessory 31 can receive the superimposed commands and perform actions accordingly. The switch controller 30 and the trackside accessory 31 may be equipped to receive and transmit RF signals in addition to communicating with superimposed signals found on and/or around track 16.

The central control module 14 may also transmit and receive data directly to/from a computer 80 and/or over a network link 82. In one embodiment of the present invention, the network link 83 comprises the Internet. The central control module 14 may be connected to other like central control modules over the network link 82 and share control and feedback information between two remote model train layouts. For example, streaming video and sound may be shared between two central control modules allowing for shared remote interaction and control. A website may be internally hosted by the central control module 14 allowing users to "visit" a specific model train layout. According to one embodiment of the present invention, the website may permit viewing of information about the model train layout objects. Streaming video, audio, and layout control could be accessed through the website. In addition, the website could be indexed at a central website accessible through network link 82, allowing users to find many different layouts from one central website/location.

Many communication links could be located on the model train layout. The various communication mediums available may be used to create a network, wherein any device can communicate with any other device that is connected to the network, regardless of the medium or mediums it must travel through. This includes information channeled through the network link (i.e., Internet) to another central control module. Commands may be sent by broadcast, by location, by medium type, etc. to specific groups of devices, to an individual networked device, or any other combination of devices.

Train Description

Figure 2:
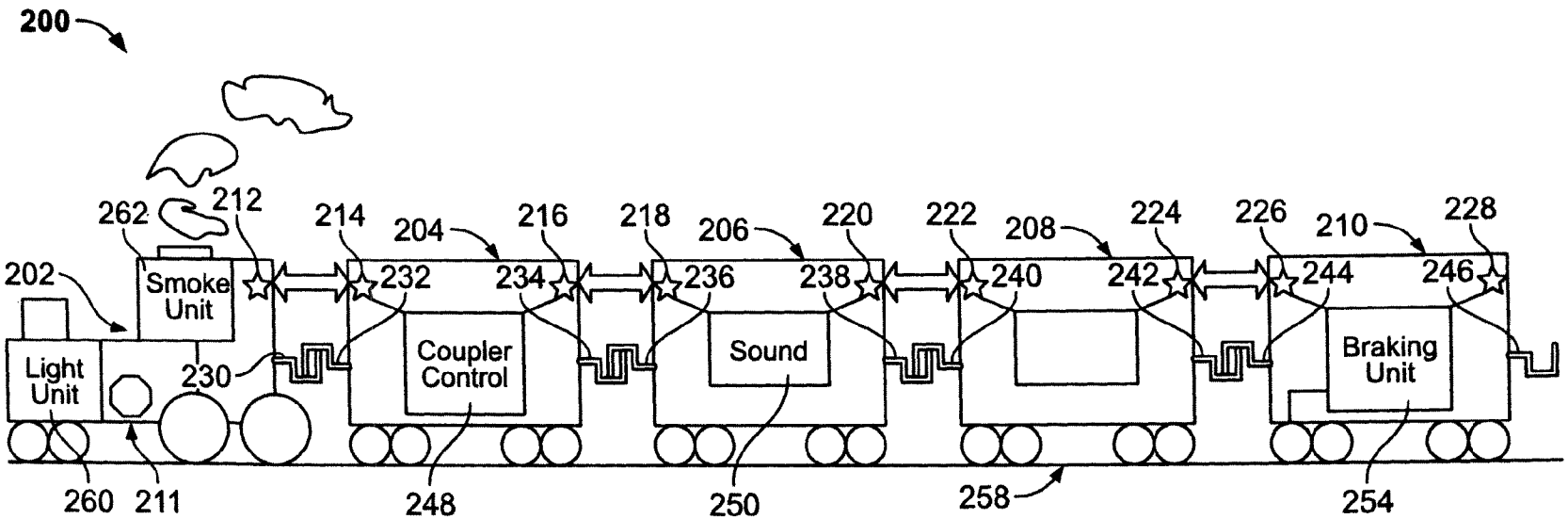
FIG. 2 illustrates an exemplary embodiment of a model train in accordance with an embodiment of the present invention.

FIG. 2 illustrates an exemplary embodiment of a model train in accordance with the present invention. Locomotive 202 contains a motor to pull locomotive cars 204-210. Located within locomotive 202 is transceiver 211 that is configured to receive superimposed commands traveling along track 258 sent from a central control module. This way, a user can use a remote control unit 12 (FIG. 1) and send commands to the train (i.e., locomotive 202 and the locomotive cars 204-210). It should be appreciated that the train may comprise only a locomotive or a locomotive (also referred to as engine) along with any number of locomotive cars (also referred to as train cars, rail cars, cars, etc.). Examples of commands sent to the train include, but are not limited to, opening couplers automatically when cars get close enough to one another, sending commands using an encrypted error byte front/back protocol, etc.

The locomotive 202 may generate a superimposed response to the central control module 14 verifying that each superimposed command has been processed. Locomotives may be equipped with a wireless transceiver identical to that found in the remote control unit 12. The locomotive 202 may "listen" and "talk" using both superimposed signals and wireless communication to help improve the communication and eliminate "dead spots" commonly found in some model train layouts. In alternative embodiments of the present invention, any other communication method to the model train may be used. A microcontroller and memory located in the engine receive commands from receiver 211 and perform the processing described herein. A communication link may also be established within the model train. For example, the model train in FIG. 2 contains a series of wireless transceivers 212-228 that transfer data from car to car (alternately, wired transceivers or one-way transmitters and receivers or just connectors could be used). Microcontrollers or other circuitry may be located on each train car with the ability to process such data and forward this information through the communication link. The result may be thought of as a dynamic networking scheme.

A series of commands may also be stored and triggered to play back in response to an input. For example, a library of different warning signal codes could be stored in memory. A command such as "Play warning signal #4" could be issued. Upon reception, locomotive 202 would play a series of commands associated with warning signal #4. Locomotive 202 may play various long and short warning signals with various delays in between. The end result may be thought of as a series of commands and timing that associate with a single command.

In one embodiment of the present invention, the model train central control module may transmit a 455 kHz and/or a 2.4 GHz expanded direct communication signal for backwards compatibility with older components and trains and new components. The benefit of the direct communication signal (such as a 455 kHz and 2.4 GHz wireless signal) is the ability to gather information at the location in which it occurs, as well as having a two-way communication ability that keeps track of the state of switch turnouts, operating cars, and accessories. In an alternative embodiment of the present invention, two receivers or transceivers may be located in a locomotive or accessory, wherein the two receivers or transceivers are used to receive commands from a remote control unit or the central control module through two different mediums. One medium may comprise, for example, an "original medium" of 455 kHz used to maintain backwards compatibility with older model train systems. The second medium may comprise, for example, a "newer medium" of 2.4 GHz and/or 900 MHz used to expand features of the model train system. Thus, two receivers or transceivers can expand and maintain backwards compatibility with older model train systems. It should be appreciated that the 900 Mhz and 2.4 Ghz bands are listed for exemplary purposes, and that other bands could be utilized as they become available through routine advancements in the art.

Train Electronics

Figure 3:
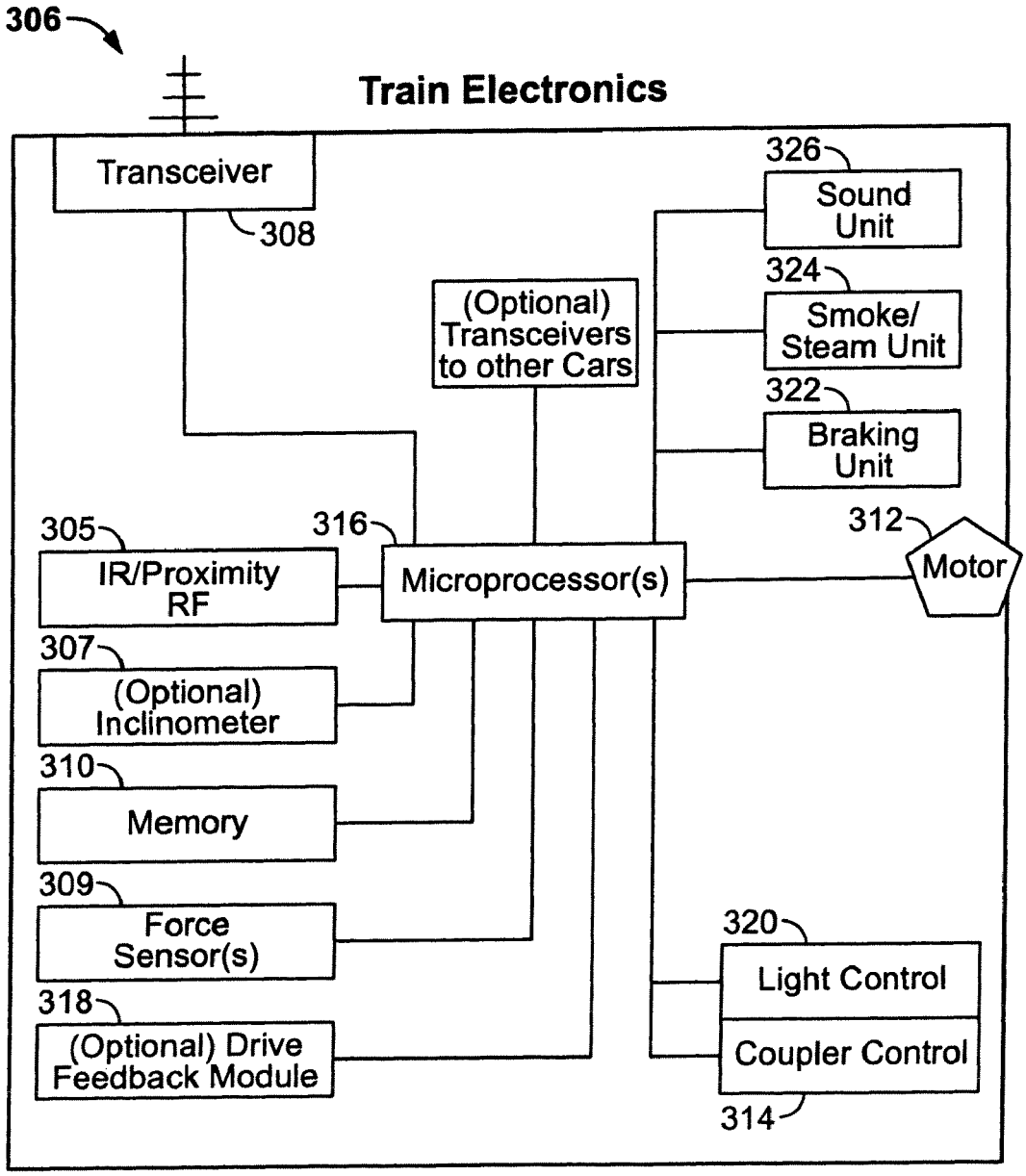
FIG. 3 illustrates an exemplary embodiment of a model train electronics system in accordance with an embodiment of the present invention.

FIG. 3 illustrates an exemplary embodiment of a model train electronics system in accordance with the present invention. System 306 is used to create a lifelike train operation experience incorporating the physics involved in model train operation, using force sensitive inputs/sensors, location sensors, angle detection mechanisms, etc. in conjunction with realistic effect generators such as sound units, steam units, microprocessor controlled lighting units, etc. System 306 may be located within a model train locomotive. Transceiver 308 receives commands sent from a model train controller (also known as a remote, remote control, remote control unit, etc.). In one embodiment of the present invention, system 306 uses a receiver in place of transceiver 308. IR/proximity RF transceiver 305 is configured to receive commands when a user directly points and sends commands to system 306. In alternative embodiments of the present invention, IR/proximity RF transceiver 305 could simply be a transmitter broadcasting a model train's identification number to a receiver in a remote control unit. Commands are sent to microprocessor(s) 316 for processing. It should be appreciated that microprocessor 316 may comprise a plurality of microprocessors.

Optional inclinometer 307 may be used to collect data providing elevation information (i.e., the train is moving downhill, uphill, etc.). In an alternative embodiment of the present invention, a special car equipped with an inclinometer or other elevation detection device could be sent around a track layout, wherein the special car could report locations of hills to a model train controller. This information could then be transmitted to another model train or datarail reporter. An angle detecting mechanism/circuit could be used to determine the angle of certain horizontal planes within the model train layout. Examples of using the angle detecting mechanism/circuit may involve determining where track curves are located in order to map a complete model train layout, providing appropriate model train sound/light effects, or other purposes. Force sensor(s) 309 is configured to provide data indicating the load (i.e., number of cars) the locomotive is pulling. Force sensor 309 could be located in the couplers of a rail car. It should be appreciated that these data inputs/commands may be stored in memory 310.

Microprocessor(s) 316 has the ability to take in commands and other data inputs and perform desired model train commands. For example, a light command turning on the lights on a locomotive involves microprocessor 316 activating light control unit 320. In one embodiment of the present invention, light control unit 320 may use low voltage threshold LED's to keep the lights on under low track voltage conditions. Light control unit 320 could also be adjusted by microprocessor 316 to compensate for a voltage change. A coupler command opening the coupler on a locomotive involves microprocessor 316 activating coupler control unit 314. When motor commands are sent, microprocessor 316 controls motor 312. In addition, microprocessor 316 is configured to control braking unit 322, smoke/steam unit 324, and sound unit 326. In one embodiment of the present invention, smoke/steam unit 324 comprises a non-squirrel cage propeller fan. In another embodiment of the present invention, smoke/steam unit 324 uses an atomizer to generate smoke/steam effects. The sound unit 326 may comprise a sound effects processor, audio amplifier and speakers. The microprocessor 316 provides suitable commands to the sound effects processor to select an appropriate sound effect file and convert the file to audio signals. As generally known in the art, the sound effects processor may be equipped to impart various effects to a selected sound file, such as an echo or reverb effect, as well as to alter pitch, volume and other characteristics. Commands may also be sent through a communication link (i.e., to transceivers of other cars), where a command is to be implemented on another car.

Examples of other devices that could be used in the model train system include, but are not limited to, an optional drive that could be used to generate a moving bell, and an optional IR transceiver/ultrasonic detector acting as a collision avoidance system that could be used to detect if objects are in front/behind the train by reflection of IR/ultrasound, thereby automatically slowing a train to a "coupling speed" (i.e., a speed wherein neighboring cars can couple to each other). In addition, an optional video module may wirelessly broadcast video from inside the train containing adjustable stereo sound, camera pitch, angle, and direction by a remote control unit, wherein the camera may automatically look around track corners. The video could appear on a display on the remote control 12, as a separate display, be transmitted to a computer, or be transmitted over the Internet. In other embodiments of the present invention, other devices that could be used in the model train system include a drive feedback module 318, an optional driver for moving rain wipers, doors, windows, etc., an optional audio/FM transmitter in the train that broadcasts engine sounds which could be tuned into by a stereo to create louder train sounds, an optional ultrasonic steam generator/other steam unit, and an optional high pressure gas system for generating a steam blow-off effect. Still in other embodiments of the present invention, other devices that could be used in the model train system include an optional voltage coupler multiplier circuit that allows couplers to fire under low track voltage conditions.

In one embodiment of the present invention, a compass or other type of directional sensing mechanism (directional radio transmitter, potentiometer, encoder, capacitive encoder, or other type of rotational sensor) may be mounted in a model locomotive/car so that the directional sensing mechanism can detect turns, thereby allowing the model locomotive to detect changes in direction. This information may be combined with the known rate of travel of the model locomotive to map out the locational movement of the model locomotive around the model train layout. In another embodiment of the present invention, it is possible to use the locational information to create an image of the model train layout on a remote control unit, computer, website, etc. A datarail reporter may be used to "zero" out the location of the model locomotive, or the model locomotive could electrically detect a special piece of track that will "zero" its location. The purpose of zeroing the location is to correct any miscalculation that may take place over time as the locomotive travels around the model train layout. It should be appreciated that the directional sensing mechanism may be mounted in the train as well as in the trucks of a model train system. To achieve even finer granularity in mapping out the model train layout, distances between zero points could be measured by tracking the numbers of train wheel rotations. This could be achieved using an encoder coupled to the train wheel and mathematically converting the distance between adjacent points of the encoder to a physical distance traveled by the train.

In one embodiment, a train can have two controllers or processors to divide up the work. A first processor can be configured to perform a first function, with a second processor configured to perform a second function related to the first function. For example, one processor may monitor sensors, such as the current applied to the motor, and the other processor may control effects, such as generating smoke, whistle sounds, lights, etc. The first processor can pass status information regarding the sensors to the second processor, which then acts on the information. A bidirectional communication link can be used between the first and second processors, allowing synchronization. Alternately, the processors could share tasks, or have any other division of labor, such as dividing up monitoring, controlling, communicating with a base unit or remote control, etc. For example, one processor may be responsible for providing data verification using an error detection and/or correction scheme to insure data integrity and reliable operation.

Remote Control and Base/Charger

Figure 4A:
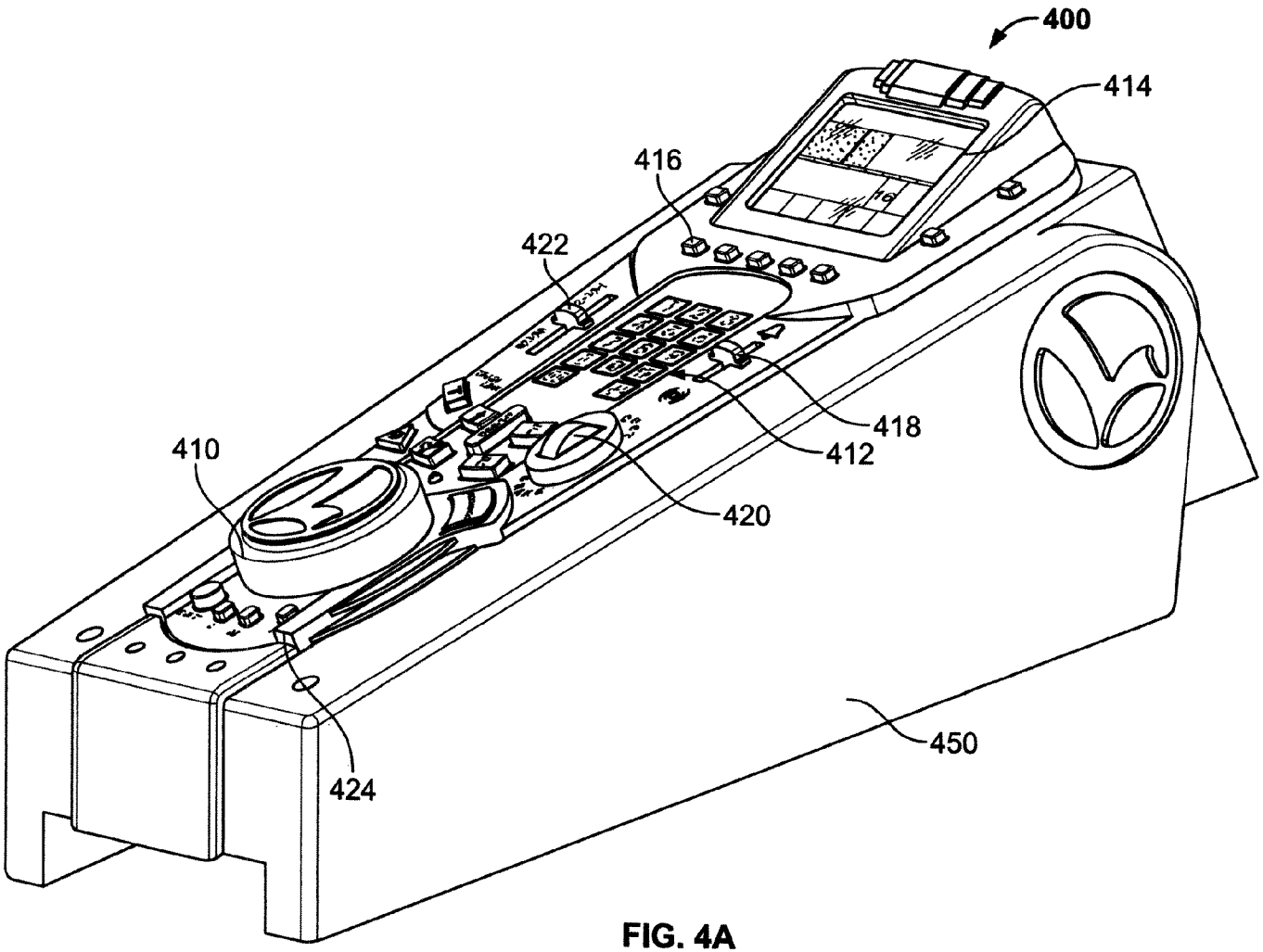
FIGS. 4A and 4B illustrate an exemplary embodiment of a model train controller in accordance with an embodiment of the present invention.
Figure 4B:
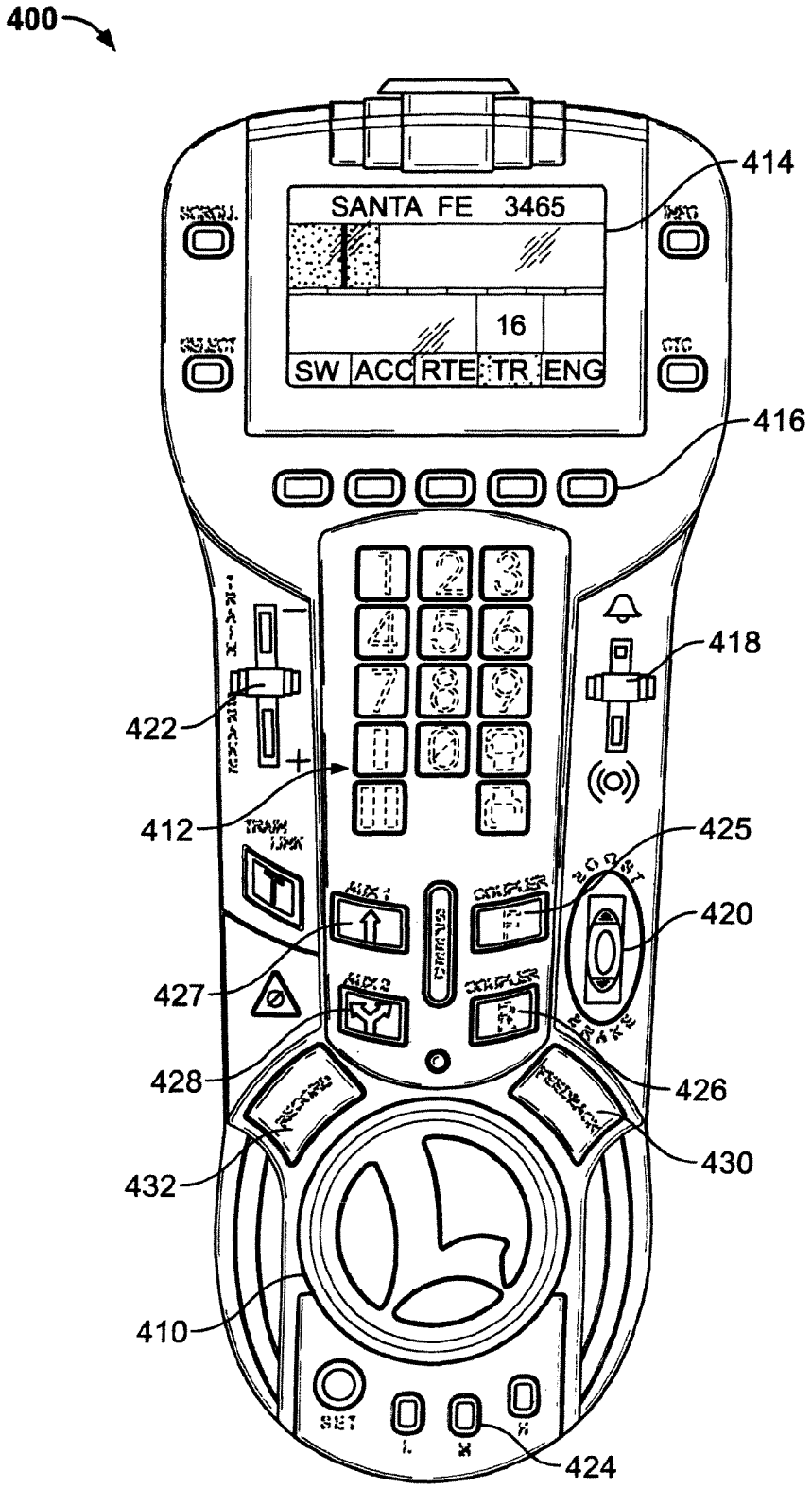

FIGS. 4A and 4B illustrates an exemplary embodiment of a model train controller in accordance with the present invention. FIG. 4A shows a perspective view of a remote control 400 installed in a base/charger 450. As described above with respect to FIG. 1, the remote control 400 communicates signals wirelessly to the base/charger 450, which then couples the signals to the track. The remote control 400 may also be adapted to communicate wirelessly with other like remote control units. The remote control 400 may also be referred to as a remote, controller, remote control unit, etc.

The base/charger 450 includes circuitry to recharge the battery contained in the remote control 400 and convert the received signals from the remote control to information signals to the train. The base/charger 450 may serve as a central hub for communication between plural remote control units and the train, and would therefore be adapted to communicate bi-directionally with each of the individual remote control units. The base/charger 450 may further include a memory to store information concerning the layout, so that this information is available to each of the remote control units in communication with the base/charger 450. Accordingly, it should be appreciated that the remote control 400 may be operated either while it is coupled to the base/charger 450 or separated from the base/charger. Moreover, the base/charger 450 may be physically coupled to or engaged with other like base/chargers to form a control panel for operating plural model trains within a common layout. Since the remote control 400 and the base/charger 450 operate together in terms of communicating signals to the model train, it should be appreciated that any functionality described herein with respect to one could alternatively be included in the other. It should be appreciated that the remote control 400 could also contain some or all of the layout information. Regardless of where the information is retained, it is desirable to have the layout information available to the base/charger 450 or remote control 400 to facilitate operation of the model train with respect to the layout.

FIG. 4B illustrates a top view of the remote control 400 removed from the base/charger 450. Remote control 400 comprises a hand-held item having a rigid outer shell with a shape conducive to be comfortably held by an operator. The remote control 400 includes a plurality of control features that enable operation of the model railroad and accessories. Specifically, the remote control 400 includes a throttle dial 410, a numeric keypad 412, and a visual display 414. The throttle dial 410 comprises a freely rotatable knob that is coupled to a rotational position sensor or transducer adapted to provide an electrical signal corresponding to the rotational position and/or rotational rate of the dial. As will be further described below, the operator can control the speed of the model train by rotating the dial 410 such that clockwise rotation will increase the speed and counterclockwise rotation will decrease the speed. It should be appreciated that throttle dial 410 can be oriented in the either a vertical or horizontal plane, although the preferred orientation is horizontal panel. The throttle dial 410 may also include plural detents that provide tactile feedback as the dial is rotated to therefore allow the operator to feel both fine and course adjustments. In addition to controlling speed, the throttle dial 410 may be used for other proposes such as menu selection and accessory motion positioning.

The numeric keypad 412 comprises an array of buttons that facilitates entry of data and commands. The operator may use the keypad 412 to address a particular engine by entering the identification number for the engine. In an embodiment of the invention, the numeric keypad 412 may be provided by an LCD touchscreen that detects physical contact by the operator's finger to register a keystroke, and which therefore does not utilize mechanical buttons. An advantage of using an LCD touchscreen is that the images (e.g., numerals, letters, icons, etc.) displayed with respect to each key of the keypad 412 can be selectively changed to correspond with operational conditions of the remote control 300. For example, when entering a numeric address (e.g., the identification number of an engine), the keypad 412 could show numeric digits. Alternatively, when entering a word (e.g., the name of the engine or operator's name), the keypad 412 could show alphabetic letters. The keypad 412 could also show symbols reflecting direction (e.g., arrows), layout features (e.g., switches), or other such information. Different types of icons or symbols are displayed based on the operating mode or the type of engine or accessory being operated. This way, the number of individual keys of the keypad 412 can be minimized while providing a large number of distinct functions with which to operate the model train and layout.

It is further desirable that the keypad 412 include back lighting to facilitate the operator's ease of reading the images, such as when used in a dimly lit environment. In addition, the degree of back lighting may be adjustable by the operator so as to enable selection of a comfortable light level and/or reduce the power drain on the internal batteries.

The visual display 414 facilitates the graphic presentation of control information to the operator. In an embodiment of the invention, the visual display 414 may be provided by an LCD screen having a shape conducive to displaying several lines of text or graphical information. Like the keypad 412, the visual display 414 may include back lighting to facilitate the operator's ease of reading the images, with the degree of back lighting being selectively adjustable by the operator. The visual display 414 may further include touch sensitive elements.

The visual display 414 may be used to present a variety of textual, iconic and graphic control information representing the majority of control functions commanded by the remote control 400. For example, the visual display 414 may be used to graphically present information concerning the model train speed, including the target speed, the commanded speed, the rate of acceleration, and the train brake settings. In an embodiment of the invention, the target speed is graphically illustrated on the visual display 414 as a bold vertical line (referred to as the "target line"). The target speed represents the desired speed of the model train as selected by the operator by rotating the throttle dial 410. The horizontal position of the target line in the visual display 414 corresponds to the desired speed, such that the target line shifts to the right as the throttle dial 410 is rotated clockwise to reflect a desired increase in speed, and the target line shifts to the left as the throttle dial is rotated counterclockwise to reflect a desired decrease in speed. The commanded speed is graphically illustrated on the visual display 414 as a shaded bar (referred to as the "grey bar") that advances horizontally across the field of view of the visual display as the commanded speed increases. The commanded speed is the actual speed being commanded by the remote control 400. The color, shading or contrast of the target line and/or grey bar may be selectively chosen to facilitate distinguishing them on the visual display 414, particularly when they are overlapping. As will be further discussed below in a subsequent section, the commanded speed may differ from the target speed due to the simulated momentum of the model train, which controls the acceleration and deceleration rate of the model train in achieving the target speed.

The visual display 414 may also include textual information, such as the name and/or identification number of the engine being commanded (e.g., Santa Fe 3465). In addition, a segmented row of text characters permit the display of additional control data fields, such as switch status (e.g., SW), acceleration rate (e.g., ACC), selected route (e.g., RTE), track number (e.g., TR), and engine number (e.g., ENG). The remote control 400 may further include a row of selection buttons 416 aligned with the text characters that enable activation and/or programming of the selected control data fields. For example, if the operator wishes to select a different engine to be controlled, the operator can repeatedly push the selection button associated with the engine number control data field (e.g., ENG) to scroll through a plurality of possible engine selections that are available to be controlled on the layout. This enables an operator to quickly identify and select an engine and/or accessory.

The visual display 414 may also be used to present other graphical information, such as the route of the model train as it traverses the layout or the configuration of the model train. For example, the route may be graphically illustrated using animated symbols that reflect the status of upcoming switches. The operator may be able to alter the route by touching selected switch symbols to change their state. Further, each of the cars of the model train may be graphically shown in the order that they are assigned within the model train. The operator may be able to selectively uncouple one car from another by touching or activating an icon representing a coupling device between the two cars.

A number of other control devices are provided including, but not limited to, throttle levers, pressure sensitive or variable pressure buttons, multifunctional buttons, sliders, and triggers. Exemplary control devices include a horn control slider 418, a brake-boost control 420, and a train brake slider 422. The horn control slider 418 is used to produce sound effects such as a horn or bell. The horn control slider 418 may be configured as a lever that travels along a linear control path. The horn control slider 418 may be spring-biased to normally remain in a neutral position (e.g., the center of travel), and manual actuation of the slider against the bias will produce a desired sound effect. For example, movement of the horn control slider 418 in a first linear direction from the neutral position may be used to control bell sounds, and movement of the horn control slider 418 in a second linear direction from the neutral position (opposite the first linear direction) may be used to control horn sounds. This way, a single slider can be used to control at least two different sound effects. Alternatively, separate sliders could be provided for bell and horn sound effects, respectively. When the operator releases the horn control slider 418, the slider will automatically return to the neutral position by operation of the internal spring bias. Alternatively, the horn control slider 418 may be provided without spring-bias, in which the slider will remain at a linear position selected by the operator.

The volume and/or frequency characteristics of the sound effect may vary with the distance of travel of the slider from the neutral position. Hence, by moving the horn control slider 418 a greater distance from the neutral position, the sound effect produced is a louder and more aggressive warning sound. Conversely, by moving the slider a smaller distance, the sound effect produced is a lighter and less threatening warning sound. The intensity of the sound effects produced is relative to the distance the slider is moved from the neutral position, and the sound duration lasts as long as the slider is held away from the neutral position. Using these inputs, the horn control slider 418 can be used as a warning sound button to "play" the horn in a distinctive manner, similar to that of a real train engineer. Thus, model train operators are freed from repetitive, unrealistic prerecorded warning sound effects and have the interactive opportunity to "play" or "quill" a signature warning sound of their own in real time.

In an embodiment of the invention, the horn and/bell sound effect may comprise a plurality of individual sound effects that are generated in a combined matter based on the movement of the horn control slider 418. For example, if the horn control slider 418 is moved from the neutral position by a small amount, the horn sound effect that is produced may constitute a single horn source having particular tonal or frequency characteristics. If the horn control slider 418 is moved from the neutral position by a greater amount, the horn sound effect that is produced may constitute two horn sources that have distinctive tonal and frequency characteristics so as to produce a two-tone chord or harmonic effect. Further, if the horn control slider 418 is moved from the neutral position by an even greater amount, the horn sound effect that is produced may constitute three horn sources that have distinctive tonal and frequency characteristics so as to produce a more complex three-tone chord or harmonic effect. The bell sound effect may be produced in a similar fashion, with the number of individual bell tones produced corresponding to the distance that the horn control slider 418 is moved from the neutral position. It should be appreciated that this embodiment of the horn control slider 418 emulates the sound and operation of classic train horns in service on actual locomotives, which are typically operated by compressed air fed from a locomotive main air reservoir and actuated by a manual lever or pull-cord. Any number of individual chimes or bells can make up a diesel horn and the controller can address each one and add it to the group depending on how far the horn control slider 418 is moved. Some diesel horns have a single chime, some have two or more (with some having as many as seven). The operator can control the number of chimes added to the horn sound effect by using the horn control slider 418.

The brake-boost control 420 is used as an alternative to the throttle to temporarily increase or reduce train speed. The brake-boost control 420 may be configured as a rocker switch that pivots from a central fulcrum. The brake-boost control 420 may be biased to normally remain in a neutral position (e.g., the center of travel), and manual actuation of the control against the bias will produce a desired speed control effect. By pivoting the control in the "boost" direction, the train speed will be increased. When the operator lets go of the control, the control returns to the neutral position and the train speed returns to the level defined by the position of the throttle. Conversely, by pivoting the control in the "brake" direction, the train speed will be decreased. When the operator lets go of the control, the control returns to the neutral position and the train speed may return to the level defined by the position of the throttle. As further discussed below, the brake-boost control 420 interacts with the train brake slider 422, so that the amount of the braking effect caused by pivoting the control in the "brake" direction may be dependent on the setting of the train brake slider. Both the braking and the boosting may also produce a corresponding sound effect, such as increased "chuffing" sounds to reflect laboring of the engine in correspondence with the boosted speed, or a brake squealing noise to reflect application of the air brakes.

It should be understood that the same key or control can send out different commands based on the way they are sequenced or operated. For example, if the brake-boost control 420 is moved completely forward, this may indicate a maximum boosting condition. But, if from this condition the brake-boost control 420 is partly reduced and held at a halfway position above neutral, this would reflect a boost hold or hold current speed. In contrast, if the brake-boost control 420 is moved from neutral to the halfway position that would reflect intermediate boosting or just a smaller increase in speed. Hence, the same position of the brake-boost control 420 could provide different results depending on whether the control is moved up from neutral or down from maximum.

The train brake slider 422 is used to control a train brake effect to the train. Train brakes are used in real trains to slow a train by applying brakes to the wheels in the rolling stock being pulled by a locomotive. Each car will typically have its own brakes, and the braking is spread out over all the cars of the train. Train brakes are also used to stretch out the cars (i.e. take out the slack) so that the cars do not bang into each other traversing the upgrades and downgrades along the rails. Passenger trains may employ the train brake to avoid jostling of passengers. Therefore, train brakes are used to generate a smoother ride. The train brake slider 422 may be configured as a lever that travels along a linear control path. Operation of the train brake slider 422 may be used to simulate the operation of a train brake by producing sound effects corresponding to braking and, in some cases, by reducing speed. By moving the slider in a first direction, the amount of braking effect will be increased, causing an increase in laboring sound effect and/or smoke effect along with a possible reduction in train speed. Conversely, by moving the slider in a second direction, the amount of braking effect will be decreased resulting in a decrease in laboring sound effect and/or smoke effect along with a possible increase in train speed.

The application of the train brake slider 422 works in conjunction with speed control of the locomotive in order to simulate a braking effect. Below a certain level, the application of the train brake slider 422 may have no actual effect on train speed, and may merely control effects generation (i.e., smoke and sound) in order to simulate application of a train brake. Above that level, the application of the train brake slider 422 may cause some reduction in speed associated with increased drag. Alternatively, the model train may be equipped with a mechanical brake provided in one or more of the train cars (e.g., locomotive or rolling stock) that is directly actuated by operation of the train brake slider 422 to thereby induce a real braking or dragging effect. In another alternative embodiment, the model train may be equipped with sensors that detect turning of the rolling stock. These sensors may work in conjunction with the train brake slider 422 to produce a sound effect (e.g., squealing of the wheels) when the train goes through a turn.

The remote control 400 may further include momentum selection buttons 424 that enable the operator to select a momentum setting for the train. In a preferred embodiment, there are three momentum settings: low, medium and high. The momentum setting adjusts the train speed control so that it simulates the weight of the train. For example, a heavy train will accelerate and decelerate more slowly, while a light train will accelerate and decelerate more quickly. As will be further discussed below, the momentum controls are one of the inputs used by the future effects generator to determine command timing to achieve desired speed and effects.

The remote control 400 may further include other buttons to enable selection of various control functions, such as coupler buttons 425, 426, auxiliary buttons 427, 428, feedback button 430, and record button 432. The coupler buttons 425, 426 can be used to activate front and rear couplers on the locomotive to couple to or uncouple from other cars. The auxiliary buttons 427, 428 can be programmed to select or activate an accessory, such as a signal light or a switch. The feedback button 430 activates a haptic device within the remote control 400 that provides tactile feedback to the operator during the use of the train. For example, when the train is braking, the haptic device may produce a vibration so that the operator has the sensation of controlling a real train. Lastly, the record button 432 enables the operator to record a series of keystrokes so that the series can be executed at a later time.

It should be appreciated that different buttons associated with different functions may exist, and the stated functions and buttons may be changed and/or rearranged. For example, additional address items may be addressed such as, but not limited to, voice commands, address IDs, factory names, user names, numbers (such as a 4 digit label) on the side of a model train component, relative location in reference to another model train component, physical location, road names, model train type (i.e., diesel, steam, etc.), point and play items, and memory modules. In a second example, the touch screen key may be redefined to produce a single or multikey stoke sequence that may or may not include time stamp spacing between them. This touch screen redefinition can also include the assignment or attachment of a special icon that may be selected or created by the operator to indicate its use.

Remote Control and Base/Charger Electronics

Figure 5:
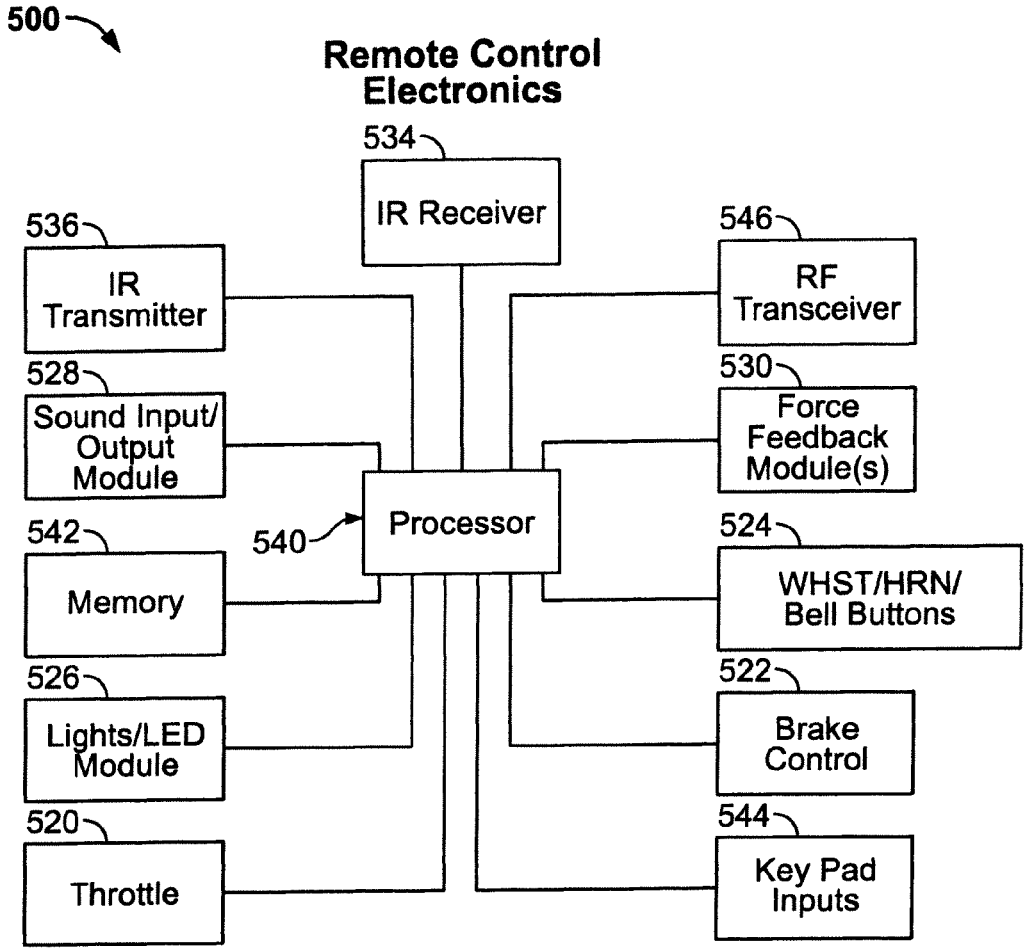
FIG. 5 is a simplified diagram illustrating an embodiment of the electronics in the remote controller of FIG. 4.

FIG. 5 is a block diagram illustrating the electronics and the interior of remote control 400 of FIG. 4. A processor 540 controls the remote control unit with a program stored in the memory 542. In one embodiment of the present invention, memory 542 is inserted through external memory slots. Keypad inputs 544, as well as throttle input 520, brake control input 522, and sound effects inputs 524 controlling whistle/horn and bell effects are provided to the microprocessor to control it. The microprocessor controls an RF transceiver 546 which connects to RF antenna to transmit commands to a central control module or directly to trains and accessories. IR receiver 534 and IR transmitter 536 are also controlled by the processor. Throttle input 520 may comprise a rotary encoder used in conjunction with the throttle dial of the remote control unit. Other optional devices in the electronics of remote control 400 include, but are not limited to, levers and sliders, force feedback module(s) 530 (i.e., vibration/lever/slider servo/resistance generator), display screens, lights/LED module 526, touch screens, touch sensitive inputs, sound input/output module 528 comprising speakers and microphones, etc. External ports may exist configured to connect keyboards, mice, and joysticks together. Lights/LED module 526 may comprise various lighting circuits that exist behind an LCD screen and individual keys. A touch pad could respond to movement of the user's finger to move through menu choices, with varying pressure or varying finger speed accelerating the movement through the menu, or otherwise varying the input.

Figure 6:
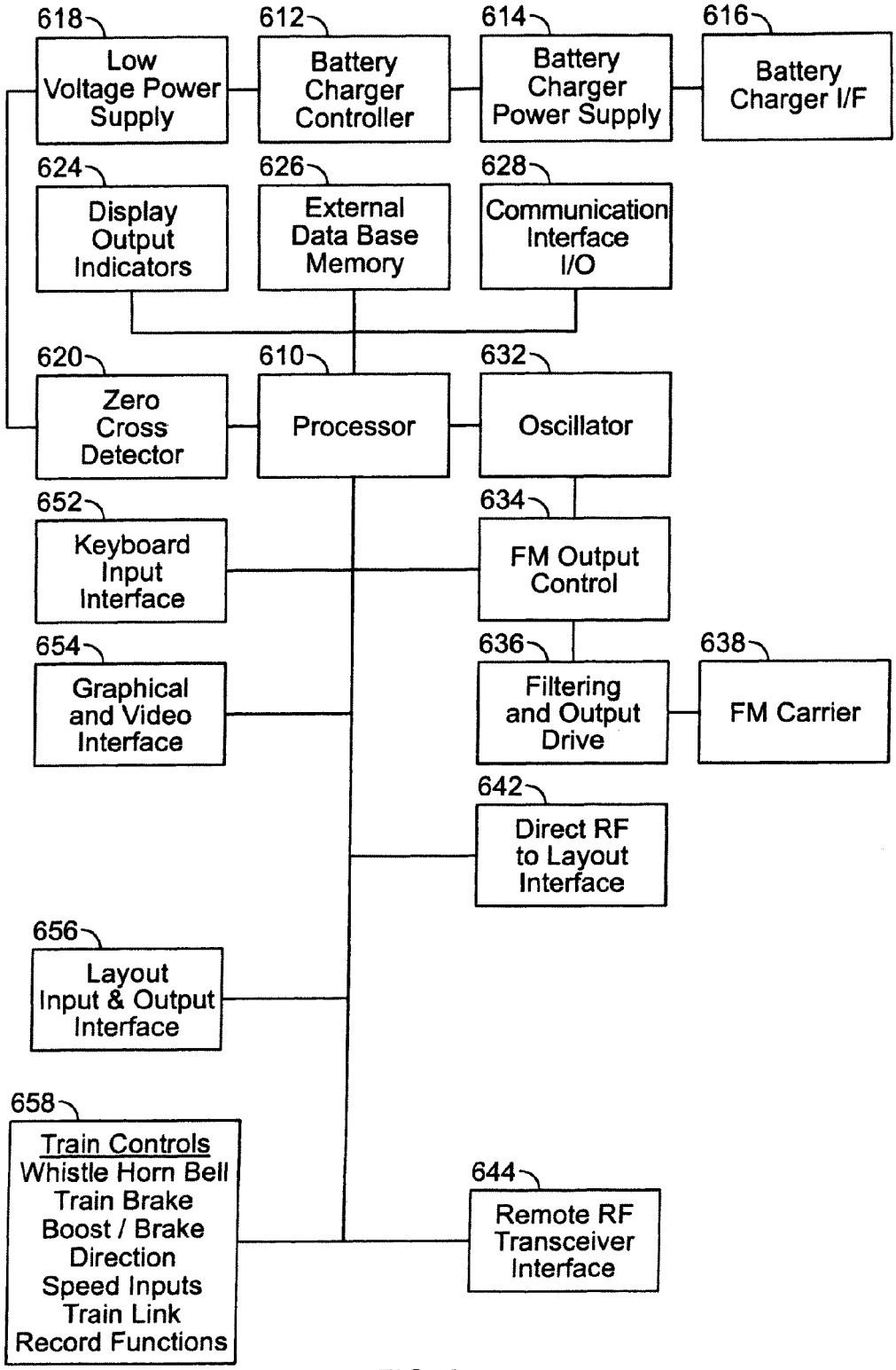
FIG. 6 is a simplified diagram illustrating an embodiment of the electronics in the base/charger of FIG. 4.

FIG. 6 is a block diagram illustrating the electronics and the interior of the base/charger 450 of FIG. 4. A processor 610 controls the base/charger unit with a program stored in the memory 626. In one embodiment of the present invention, memory 626 is inserted through external memory slots in the form of modules. The modules may provide a scratchpad memory enabling users to store data, such as configuration data regarding the layout and trains. Memory modules may also include read-only data supplied by the product manufacturer for the purpose of updating or changing system software. In one embodiment, a memory module may be supplied with a model locomotive, containing specialized data and files appropriate for the model locomotive to enable the system to activate and control certain features of the locomotive. The memory module may also be used to create a back-up copy of the system software. The base/charger 450 additionally includes a display or other output indicators (e.g., lights or light emitting diodes (LEDs)) coupled to the processor 610 to reflect current operating condition and status. The base/charger 450 may also include a communication interface 628 adapted to couple to other external electronic systems, such as a personal computer. The communication interface 628 may be provided by conventional communication devices, such as a universal serial bus (USB) port, an RS-232 port, Ethernet, wireless local area network (LAN), or other known devices or protocols.

The base/charger 450 includes circuitry adapted to provide power to the remote control when the remote control is coupled to the base/charger. A low voltage power supply 618 rectifies available AC voltage to provide a DC power source. A battery charger controller 612 is coupled to the low voltage power supply 618 and provides power and control signals to a battery charger power supply 614. A battery charger interface 616 is adapted to couple to the remote control in order to supply charging power to the battery contained within the remote control. As known in the art, the battery charger power supply 614 will regulate the power supplied to the remote control battery in order to maintain an optimal charging condition without over-charging the battery.

The base/charger 450 also includes circuitry adapted to communicate wireless signals to the model train. In particular, the remote control 400 would communicate commands and other signals to the base/charger 450, which would relay those signals to the train. The base/charger 450 would also communicate signals back to the remote control 400, such as an acknowledgment signal reflecting successful receipt and processing of a command. An oscillator 632 is adapted to produce a precision clock signal to facilitate modulation of control signals by an FM output control unit 634. The FM output control unit 634 would modulate the control signals under the control of the processor 610 using a desired modulation scheme, such as frequency shift keying or other known modulation schemes. The modulated control signals would pass through a filtering stage 636 to reduce noise and other harmonics. Thereafter, the modulated control signals are transmitted via FM carrier 638. It should be appreciated that different carrier frequencies may be used for transmission and reception of signals from/to the base/charger 450, as is generally understood in the art.

It should be appreciated that the remote control 400 and/or base/charger 450 can enable direct wireless two-way communication to/from to the engines and accessories. This could be done on either the primary communication band used by the base/charger 450 and remote control 400 or on a single or multiple secondary channels to improve bandwidth. Likewise, the engines and/or accessories can communicate with other engines and/or accessories via direct wireless two-way communication, or, in the alternative, by using the remote control 400 and/or base/charger 450 as a repeater. Two-way communication enables the communication of feedback information from the engines and accessories to the remote control 400 and/or base/charger 450, enabling the remote control and/or base/charger to have more complete information as to the status and condition of the engines and accessories.

The base/charger 450 may also modulate RF command signals directly onto the AC power applied to the track (as described above) through interface 642. In an embodiment of the invention, the base/charger 450 uses a different frequency for communications with the model train from that used for communication with the layout. These communications may also be bi-directional so that information may be received back from the layout, such as a detection signal reflecting position of the model train. A zero cross detector 620 coupled to the processor 610 enables the processor 610 to detect zero crossing of the AC waveform applied to the track in order to synchronize these command signals to the AC waveform.

The base/charger 450 would also communicate with the remote control 400 via the remote RF transceiver interface 644. This interface may enable relatively short range communication of signals bi-directionally between the remote control and the base/charger. It should also be appreciated that the base/charger 450 may communicate with multiple remote controls at once. This way, information contained within the memory 452, such as regarding the status or configuration of the layout, is accessible to all remote controls in communication with the base/charger 450. It should be appreciated that the base/charger 450 may also be adapted to communicate with other devices besides the remote control 400. In particular, the base/charger 450 may be responsive to signals generated by alternative devices including, but not limited to, a cellular telephone, personal digital assistant (PDA), universal remote control, laptop computer, and the like. By way of example, a user may adapt the base/charger 450 to communicate a command to the model train to produce a particular sound effect, such as a series of horn blasts, when the phone rings or the doorbell button is pushed.

In one embodiment, the base/charger 450 works with the remote control to manage the communication of signals to and from the model train and accessories. In this regard, the base/charger 450 may operate as a support device to the remote control and simply pass on commands and information communicated between the remote control and the model train or layout. Alternatively, the base/charger 450 may be provided with additional capability and inputs so that it can perform all tasks that the remote control could perform. In this embodiment, the base/charger 450 may include a keyboard input interface 652, a graphical/video interface 654, and train controls 658. These interfaces and controls mimic the controls provided on the remote control (described above), and may include functions such as a whistle/horn/bell, a train brake, a boost/brake, direction, speed input, train link and record functions. It should be appreciated that any function described herein that is provided by the remote control 400 could also be provided by the base/charger 450. Moreover, the base/charger 450 and remote control 400 could be integrated together into a common device, thereby eliminating redundancy between the two devices. This provides maximum flexibility to the user who may wish to control the model train using either the remote control or the base/charger.

Command and Control of the Model Train

The remote control 400 and base/charger 450 implement a command protocol that differs from other known control systems in terms of the degree of control and decision making that is made by the remote control and base/charger. In other known control protocols, such as Train Master Command Control (TMCC) by Lionel LLC or Digital Control System (DCS) by Mike's Train House, Inc., the remote control serves simply to relay user commands to the model train. The present command protocol goes further in terms of generating commands based on predicted or actual behavior of the model train in order to provide a user experience that more accurately simulates actual train operation and behavior.

The difference between the known control protocols and the present invention may be illustrated by considering the area of train speed control. With known command control protocols, such as TMCC, the operator turns a throttle knob on the remote control to effect an increase or decrease to the train speed. The remote control circuitry periodically scans the position of the throttle knob to determine a value corresponding to the amount of change from a preceding scan. A signal corresponding to the detected speed change is then communicated in the form of a speed command to the model train, which then determines the speed value to apply to the train motor while taking into account weighting factors such as momentum. The remote control will not send any further speed commands to the train unless there is further movement of the throttle knob. Likewise, every other input device (e.g., button) on the remote control may activate a corresponding command to the model train, but once that command is sent the remote control takes no further action unless there is a subsequent change to the remote control input device. In other words, the remote control issues no further commands unless there is some user input. The user must therefore actively provide inputs into the remote control in order to effect changes of the model train, and the model train responds directly to the commands received from the remote control.

In contrast, the invention provides a control protocol in which the remote control (and/or base/charger) does not passively relay commands, but rather actively generates commands to control train operation based on user input as well as other information. Exemplary applications of this inventive control protocol described herein include a dynamic engine loading calculator, a dynamic variable speed compensator, and a future events generator. The dynamic engine loading calculator takes into account various loads factors effecting train speed, such as conditions of the layout (e.g., hills, terrain, curves, etc.), configuration of the train (e.g., number and simulated weight of the cars pulled, etc.), and user inputs (e.g., amount of train brake applied, throttle setting, etc.) in calculating speed commands delivered to the train. Similarly, the dynamic variable speed compensator enables a user to select a target speed, and then generates a series of speed commands in order to transition the model train from its current speed to the target speed. In this manner, the dynamic variable speed compensator works in conjunction with the dynamic engine loading calculator to produce a stream of successive speed commands that control the rate of change to the train speed to achieve the target speed in a manner that simulates response in a realistic manner to various load factors. The remote control may include a graphic display to enhance the user's experience by illustrating visually a relation between target speed and commanded speed, giving the user an illusion of control over the model train in a way not previously achieved.

The future events generator takes the user experience a step further by anticipating the user's operational desires and executing scenarios that are appropriate for the type of train, operating environment, and remote control settings. The remote control (and/or base/charger) would autonomously generate commands controlling the train speed as well as effects (e.g., sound, smoke, animation, etc.) in order to simulate the scenarios. Further, the generated commands may not only control train functions, but would also control accessories and other aspects of the model train layout (e.g., switches, lights, bridges, etc.). All of these functions would occur without direct user control and would thereby give the illusion that the model train has a "mind of its own."

It should be appreciated from the following discussion that commands generated by the dynamic variable speed compensator and/or the future events generator could be calculated in advance, calculated at the instant required, queued in a memory (e.g., first-in, first-out (FIFO)), and changed or modified based on user inputs, environment changes, or other factors prior to execution by the model train.

Dynamic Engine Loading Calculator

Model train operation traditionally was operated in a "conventional" mode, wherein voltage applied to a track was increased and decreased to speed up and slow down a model train, respectively. The standard method for controlling the voltage to the track was via a throttle lever on a transformer. Conventional engines had simple operations and were susceptible to variations in speed when a constant voltage was applied to the track. For example, a train engine running at 10 volts would noticeably slow down when traveling up a steep incline or around a curve in the track. The operator would have to take notice of the upcoming conditions and manually adjust the voltage to attempt to have the engine maintain a somewhat constant speed up the hill, down hills, around curves, etc. The voltage operation range of the engine would also change depending on the load that the engine was pulling. For example, an engine that was not pulling any cars would begin to move when about 6 VAC (volts AC) was applied. However, a train that was pulling a large amount of cars may not begin to move until about 8 VAC was applied. The extra voltage applied was the extra power needed to overcome the inertia of the motor in addition to the weight of the cars being pulled.

The invention provides a dynamic engine loading calculator that seamlessly allows realistic motor operation of the engine taking into consideration the forces acting against the engine. The Calculator takes into consideration various factors such as the level of incline the train is traveling, the weight of cars being pulled, the train brake applied, and other factors that calculate the amount of power to be added or removed for the train to reach the "target speed" entered by the user. This removes the need for the user to manually adjust for such conditions. The dynamic engine loading calculator does these operations in such a way as to mimic real train operation. For example, the dynamic engine loading calculator may hold the speed constant or allow the engine to vary in speed within a particular range to simulate the realistic speed fluctuations and other conditions experienced by a real train.

Figure 7:
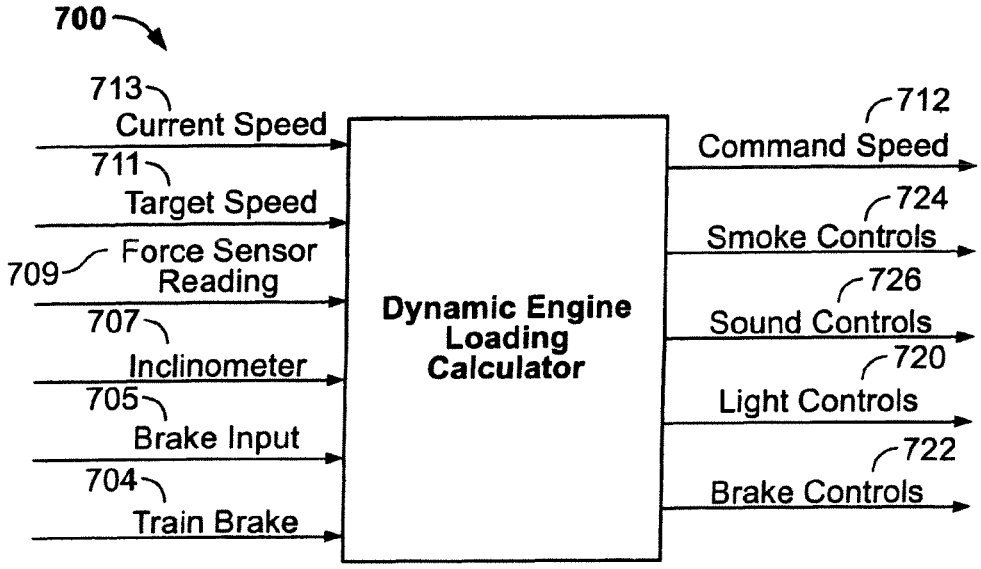
FIG. 7 is a diagram of a Dynamic Engine Loading Calculator in accordance with an embodiment of the present invention.

FIG. 7 is a diagram of a dynamic engine loading calculator in accordance with the present invention. This Calculator can be implemented in software and/or hardware in the remote control unit, Central Control Module, or even the train itself. The dynamic engine loading calculator 700 may comprise one or more processors/systems. One or more of the inputs shown on the left side of FIG. 7 (i.e., inclinometer or accelerometer 707, force sensor reading/input 709, train brake input 704, brake input 705, etc.) are used to produce one or more of the outputs shown on the right side of FIG. 7 (i.e., command speed motor output 712, light controls 720, brake controls 722, smoke controls 724, sound controls 726, etc.) according to an embodiment implemented in the present invention. It should also be noted that current speed input 713, target speed input 711, force sensor reading 709, inclinometer/accelerometer input 707, train brake input 704, and brake input 705 are not exclusive to the dynamic engine loading calculator, and can be shared with other aspects of the systems simultaneously. It should be appreciated that train brake input 704 acts more like a trim rather than a brake (brake input 705).

The dynamic engine loading calculator simulates realistic engine operation taking into consideration the factors that would effect a real train's operation. In order to do this, different forces that would affect a real train may be actually measured on the model train or selected by the user. Using this information, the dynamic engine loading calculator can produce a speed as well as effects and sounds that mimic those of a real train. An example of such effects is the sounds and level of smoke a real train would produce when struggling to overcome the force of a large load hindering acceleration. The difference between the target speed and the current rate of movement can be used to determine an acceleration profile, or a fixed acceleration could be used regardless of the difference. In some cases, the dynamic engine loading calculator may determine that a target speed is not obtainable, and therefore, the command and target speed will never match or the condition exist that causes the engine to vary in speed.

In alternative embodiments of the present invention, target speed input 711 and force sensor reading 709 can be used to determine the acceleration to attain the target speed depending on the amount of force sensor reading 709, which would correspond to the load of the model train engine. In other alternative embodiments of the present invention, instead of using force sensor reading 709, a user could indicate and store the number of cars in a particular addressed train, and a force or load proportional to the number of cars could be assumed by the Calculator. The basic acceleration that is derived from the current rate of movement of the engine and the target speed to be achieved is then modified with the inputs of the train brake, inclinometer/accelerometer, and force sensor to create a new acceleration profile. Due to this, the same engine without a heavy load may accelerate quicker and with more ease in comparison to the same train with a heavy load. Also, the amount of smoke and the labor of sounds of the train may increase based on the calculations that the train must overcome greater forces wherein the motor would realistically be under a greater labor and strain.

Figure 8A:
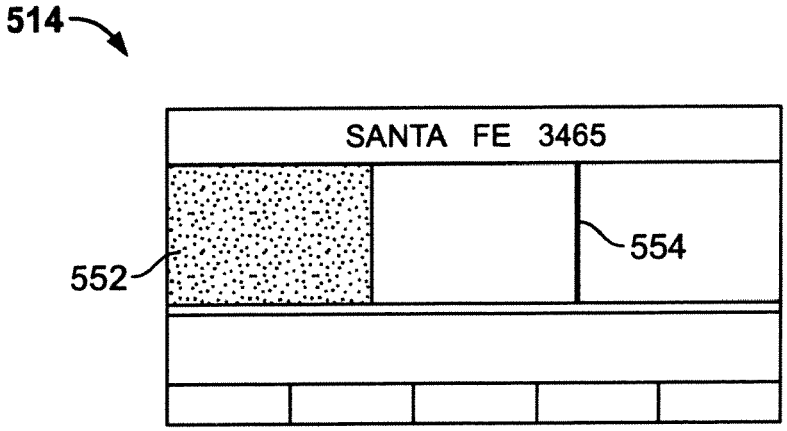
FIGS. 8A and 8B illustrate a visual display of the model train controller of FIGS. 4A and 4B reflecting different speed conditions.
Figure 8B:
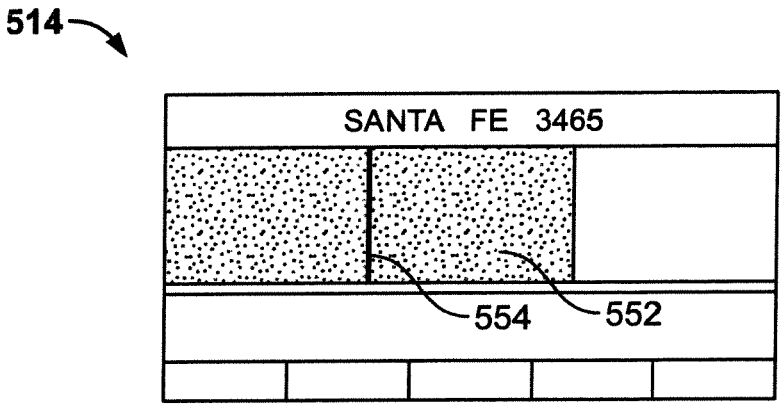

FIGS. 8A and 8B illustrate the exemplary visual display 414 of the remote control 400 reflecting two different speed control conditions. In the condition of FIG. 8A, the operator has shifted the target line 454 to the right by operation of the throttle dial 410, reflecting a desire to increase the train speed above the current commanded speed shown by grey bar 452. The grey bar 452 is lagging behind the target line 454 due to the simulated momentum of the train. If the target line 454 remains at its current position, the grey bar 452 will gradually advance to the right until it coincides with the target line 454, with the rate of advancement of the grey bar (i.e., rate of acceleration of the train) determined by the momentum setting. In the condition of FIG. 8B, the commanded speed (i.e., grey bar 452) has reached the former position of the target line 454 from FIG. 8A. But, the operator has now shifted the target line 454 back to the left by operation of the throttle dial 410, reflecting a desire to decrease the train speed below the commanded speed. The dynamic engine loading calculator would calculate the commanded speed based on the target line 454, the current commanded speed, the momentum setting, and the other inputs discussed above.

The example of FIG. 8A reflects a relatively large difference between the grey bar 452 and the target line 454. Accordingly, the locomotive would have to labor in order to accelerate to the target speed. This laboring may be reflected by altering the sound and/or smoke effects (e.g., to increase the engine sound and/or volume of smoke) for a period of time.

Then, as the grey bar 452 approaches the target line 454, these sound and/or smoke effects may be tapered off. It should be appreciated that this mode simulates actual train operation in which the train must work hard (e.g., by burning extra coal) to accelerate to the target speed, and the throttle is reduced once a desired acceleration rate is achieved so as to not overshoot the target speed. Hence, the trigger for initiating sound and/or smoke effects may relate to the difference between the commanded speed and target speed, rather than the actual train speed.

Optionally, an inclinometer/accelerometer or another type of force or angle detection circuit such as a digital pendulum could indicate the pitch or elevation of a train, showing whether the train is on a hill, and provide this information to the Calculator. In alternative embodiments of the present invention, the location and height of hills on the model train layout could be entered by the user, or a special car equipped with an inclinometer or other elevation detector could be sent around the model train layout to generate a map containing this elevation information. For example, the Calculator can take into account the length of the train, providing a load value when the engine reaches the top of a hill, and a different load value when the middle of the train reaches the top of the hill. Other inputs to Calculator 700 may include force sensitive inputs from the train or a remote control unit, the number of cars the train carries (e.g., determined by a datarail reporter and sent to the locomotive, or entered by a user), and the engine current draw, which could also be used to detect binding, wherein this information can be used to improve starts.

The following describes an example of an embodiment of the present invention. It should be appreciated that the example in no way limits the essential characteristics of the present invention. A user may input a desired or "target" speed level using a motor throttle 410 of remote control unit 400. For example, a target speed level of 100 (out of a scale of 200) may be input by the user. This target speed is provided to the dynamic engine loading calculator 700, which determines an appropriate acceleration and power level applied to the motor in order to reach the target speed, and outputs a series of command speeds to reach that target speed, over a finite period of time. It should be appreciated that the target speed is provided regardless of power input simulating an increase in the load of a model train. According to an embodiment of the present invention, the power of the track does not control the speed of a model train.

For example, if the previous target speed level was set to 80, commands of 81, 82, 83, on up to 100 may be issued successively, e.g., every ½ second. These command speeds are transmitted sequentially (e.g., every ½ second) to the locomotive. These command speeds are received by transceiver 308 (FIG. 3), sent to microprocessor 316 and stored in memory 310. It should be noted that microprocessor 316 may comprise one or more microprocessors working together to control the train. The microprocessor provides control signals to motor 312 to adjust its power. Incrementing speed levels are sent to the motor until the engine reaches the target speed level. In one embodiment of the present invention, the incrementing speed levels may comprise commands being sent out (if the Calculator is located within the remote or central control unit), or may be in the form of increasing the power to the motor of the train over a finite period of time (if the Calculator is located within the train). In one embodiment of the present invention, using the remote control unit to increment speed levels could result in the graphing such an increase, or providing a numeric representation of such an increase, without confirmation from the remote control unit. In an alternative embodiment of the present invention, the speed levels could be displayed on the remote control unit, where the speed levels are read from the train via a two-way communication link.

Figure 9:
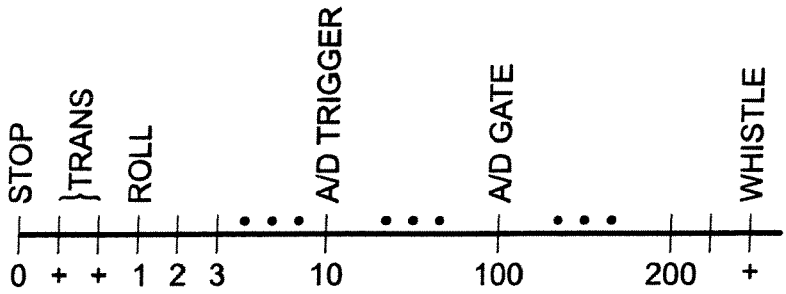
FIG. 9 is a diagram illustrating an exemplary arrangement of speed steps providing sequence control in accordance with an embodiment of the present invention.

FIG. 9 illustrates graphically a range of successive command speed steps that correspond to speed commands produced by the Calculator. At one end of the range, a speed step of 0 corresponds to a dead-stopped condition of the locomotive, and a speed step of 1 corresponds to initial rolling motion of the locomotive. Whereas, at the other end of the range, a speed step of 200 corresponds to a top speed of the locomotive. For each speed step, the Calculator would send a corresponding command speed to the locomotive as discussed above. The actual speed corresponding to the speed steps may be predetermined or programmable by the user. Moreover, the actual speeds may change at a linear rate from one speed step to the next, or alternatively, may change at a non-linear rate. For example, the differences in actual speed at the lower end of the speed step range may be relatively small so that the operator has a lot of granularity in controlling the movement of the train. In contrast, the differences in actual speed at the higher end of the speed step range may be relatively large, since granularity at the higher speeds is less important. The memory 310 may include a look up table used to translate between the speed command and the motor power level that would yield the desired actual speed. The embodiment of FIG. 9 shows 200 exemplary speed steps, though it should be appreciated that a higher or lower number of speed steps could be advantageously utilized.

In accordance with an embodiment of the present invention, when the speed level information is first processed, the "command speed" level does not match the "target speed" level. As with the speed of a real train, if locomotive 202 were to travel up a hill, the train would move slower due to the force of gravity, and locomotive 202 would "try harder" to reach the top of the hill. In accordance with an embodiment of the present invention, it is possible for the forces acting upon a train to limit the maximum speed the engine can travel. For example, the train could attempt to reach a target speed that is not attainable, due to factors opposing the movement of the train (such as a heavy load, a large amount of train brake, a steep incline, etc.), wherein the train may in effect plateau at the present maximum speed the train can travel given the present power input. In another embodiment of the present invention, when the sum of the negative factors are removed (e.g., the train with a heavy load ascends a hill and is now traveling down an incline), it is possible for the train to exceed the target speed due to the engine not being able to back off power fast enough to compensate for both the real and simulated positive forces toward movement.

As mentioned above, in keeping with the goal of creating a realistic train operating experience that is more accurate in the modeling of movement and laboring sound, lighting, and smoke effects of a train, dynamic engine loading calculator 700 takes the target/command speed relationship of a model train locomotive and other factors to produce a laboring value to drive the sound, lighting, and smoke effects. In one embodiment of the present invention, dynamic engine loading calculator 700 receives the target/command speed relationship from microprocessor 316 (FIG. 3), evaluates the condition of force sensor, inclinometer, brake input, and train brake levels, and provides different intensities to sound, lighting, and smoke effects of a model train system based on the current state of the system. In one embodiment of the present invention, dynamic engine loading calculator 700 is configured to receive feedback, wherein such feedback may include an integral term, a derivative term, and a proportional term of the motor control. These inputs can be used in conjunction with current speed input 713, target speed input 711, force sensor reading 709, inclinometer 707, brake input 705, and train brake input 704 to influence different events and scenarios of the train as well as incite additional changes to the intensities of sound, lighting, and smoke effects.

Dynamic engine loading calculator 700 decides the intensity of sound and smoke effects by evaluating the relationship between the "set" or "target speed" and the "command speed" being measured. As defined above, the "target speed" is the ultimate speed value that is to be achieved, whereas the "command speed" is the present speed information being sent to the servo motor to reach the "target speed." By measuring this varying relationship, the intensity of the smoke effects produced by smoke unit 324 and the engine/chuff sound produced by sound unit 326 can be calculated into multiple different levels. Also, a dynamic variable speed compensator of the present invention does not immediately overcome the effect of loading on the model train, a longer duration of laboring or drifting smoke and sound effects can be triggered. More details regarding the dynamic variable speed compensator are discussed in subsequent sections of the detailed description of the present invention. With multiple different levels of smoke and sound effect intensity and duration, as compared to the three levels of intensity provided in conventional systems, a higher resolution and more dynamic result of realistic smoke and sound effects may be achieved. Thus, dynamic engine loading calculator 700 implements a gradually changing speed, tempo, and cadence, with a much higher resolution of smoke and sound effects, resulting in a more realistic sound and movement of a working model train.

The speed step range could also be used by the dynamic engine loading calculator 700 to trigger various effects, including sound effects, smoke effects, and other animation effects. Referring to FIG. 9, certain speed steps may be programmed to cause certain effects to occur. For example, between speed steps 0 and 1, the speed step range includes a plurality of transition (i.e., TRANS) steps that are triggered by changes of the target speed by the operator. In particular, the effects may be triggered by transitions of the target speed in either an increasing speed direction or decreasing speed direction, and the effects may be different depending upon the direction of the target speed transitions. A first TRANS step (between speed steps 0 and 1) in the increasing speed direction may trigger production of a first effect, such as the sound of steam releasing from the brake system, which ordinarily accompanies the departure of a train from a dead stop. A second TRANS step (between speed steps 0 and 1) in the increasing speed direction may trigger production of a second effect, such as the sound of the train horn, which would also ordinarily accompany the departure of a train from a dead stop. Hence, as the target speed is moved from speed step 0 (dead stop) to some higher value, the effects associated with the first and second TRANS steps will occur before the speed step 1 command is delivered and the train begins to roll. These effects mimic operation of a real train and enhance the realism and enjoyment of the model railroad.

In the decreasing speed direction, the TRANS steps may produce entirely different effects. For example, a first TRANS step (between speed steps 1 and 0) in the decreasing speed direction may trigger production of another sound effect, such as the sound of screeching brakes as the arriving train comes to a halt. The second TRANS step may be ineffective in the decreasing speed direction, or alternatively, may trigger production of yet another sound effect. Hence, the same TRANS step may be used to produce two different effects depending upon the direction of the target speed change. Moreover, there may be multiple possible effects associated with a TRANS step that can be randomly or systematically selected dynamic engine loading calculator 700. For example, one time that the target speed passed through the second TRANS step in the decreasing speed direction, the sound unit may produce the sound of the conductor announcing "NOW ARRIVING AT THE STATION." Another time under the same conditions the sound unit may produce the horn sound. This way, the same effect is not repeated each time the TRANS step is traversed, thereby increasing the spontaneity and unpredictability of the model train operation.

At the opposite end of the speed step range, a third TRANS step may produce other effects. For example, the third TRANS step (above speed step 200) may trigger production of a whistle. Accordingly, the operator could use the throttle knob to cause the production of sound effects instead of using other buttons or keys on the remote control. In this regard, the operator can rotate the throttle knob abruptly to change the target speed to the top of the speed range to cause the whistle to blow, and then return the throttle knob back to its previous position. In view of the simulated momentum of the train and resulting slow reaction of the command speed to changes of the target speed, the actual train speed (i.e., command speed) may not change very much notwithstanding the rapid changes to the target speed.

The speed step range may further include certain speed steps that serve the additional purpose of triggering logic changes that control the manner in which effects are generated by the TRANS steps. For example, in FIG. 9, speed step 10 is designated as an arrival/departure trigger (A/D TRIGGER) and speed step 100 is designated as an arrival/departure gate (A/D GATE). The dynamic engine loading calculator 700 may keep track of whether and how frequently the target speed passes through one or both of the A/D TRIGGER and A/D GATE, and then select or modify effects accordingly. The effects produced by the first and second TRANS steps in the increasing speed direction might only be generated when the target speed is changed in a movement having a magnitude that is greater than the A/D TRIGGER. According to this exemplary embodiment, the sound effects would be produced if the operator moves the throttle knob to effect a desired speed change from speed step 0 to speed step 20. Since the target line passes speed step 10, designated at the A/D TRIGGER, the effects associated with the first and second TRANS steps would issue. Such a large speed increase would normally be associated with a departure of the train from a station, in which the sound effects would be appropriate. On the other hand, a smaller speed increase, such as if the operator moves the throttle knob to effect a desired speed change from speed step 0 to speed step 5, would not produce the sound effects. Likewise, in the reverse direction, a large speed decrease in which the target line passes speed step 10 to speed step 0 would produce the braking effect, which would normally be associated with an arrival of the train at a station. A smaller speed decrease would not produce the same effect. Hence, the operator can directly control the production of these speed triggered effects by controlling the magnitude of target speed changes.

Further, the speed triggered effects may also change if the target speed had passed through A/D GATE. When a real train runs at a high speed it will tend to heat up, so the sounds it produces after it stops will be more accentuated than it would had it merely reached a slower speed. In the present embodiment, when the target speed is reduced from above A/D GATE to a full stop (passing through A/D TRIGGER and the first and second TRANS steps), the effects produced will be modified to reflect the prior high speed operation. For example, a steam releasing sound effect may be louder and more pronounced. As noted above, the dynamic engine loading calculator 700 will keep track of the number of times that the target speed passes through the A/D GATE and A/D TRIGGER steps.

The effects associated with the TRANS steps may either be preprogrammed for a particular engine, or may be programmable at the discretion of the operator. It should also be understood that the effects are not limited to sound effect, but that other effects such as the generation of smoke or other actions may also be triggered automatically by changes of the target speed that pass through the TRANS steps. For example, the model train may include animation effects, such as the conductor waving his hand or looking out the window as the train arrives or departs a station. As noted above, different effects may be produced each time so as to enhance the realism and spontaneity of the model train.

It should be appreciated that dynamic engine loading calculator 700 may not directly control the motor of a train. The Calculator 700 sends what would be considered the attempted speed for the train, in terms of motor power with all the factors of force and load taken into consideration. This information is sent to the dynamic variable speed compensator of the present invention, which strives to maintain within a reasonable varying range the target power level provided to achieve the target speed entered by the user. In this manner, the "responsibility" of engine speed control may be construed as divided amongst these two units (i.e., the dynamic engine loading calculator and the dynamic variable speed compensator). Of course, it would also be possible to implement a speed control system that does not include a dynamic variable speed compensator, and in which the dynamic engine loading calculator 700 determines an attempted speed and the processor communicates a corresponding speed command to the model train. In that case, the model train would travel at a fixed speed defined by the speed command without the varying range intended to mimic actual train performance.

Dynamic Variable Speed Compensator

The dynamic variable speed compensator of the present invention can exist in either software and/or hardware. In one embodiment of the present invention, the basic form of the Compensator comprises an apparatus and method configured to control a model train motor of a model train locomotive, a medium for receiving the target speed or target motor power level, an apparatus and method configured to estimate the current level of movement of the train, and an algorithm for compensating the motor movement.

According to one embodiment of the present invention, the Compensator uses pulse width modulation as the method for controlling the motor. A pulse width modulator (PWM) has many different possible configurations. In one embodiment of the present invention, a method for controlling the motor involves using a random number generator (i.e., a white noise generator) to vary the frequency of the PWM. A continuous generation of random numbers will produce numbers that are evenly distributed throughout the sample pool. Thus, the average of the PWM frequency will be the value that is set for the power output. The other advantage of using the random number generator for controlling the motor is that harmonics that would normally be generated throughout the system are reduced so that their effect is effectively removed. In addition, the motor could operate in the audio spectrum without a distinct tone, or the motor could run without a human hearing the motor. In one embodiment of the present invention, in addition to PWM, a constant voltage output can also be used to enhance low speed operation where the PWM becomes inefficient.

The dynamic variable speed compensator receives the target power/target speed information from the dynamic engine loading calculator. It should be appreciated that the dynamic engine loading calculator could exist in two separate microprocessors in separate systems and use a method such as serial communication to transfer the power/speed information between the systems. In another embodiment of the present invention, the Calculator and Compensator could be two separate systems operated by one microprocessor. In the one microprocessor embodiment of the present invention, the power/speed information would be passed between the two systems via a software stack, RAM, or nonvolatile memory within the microprocessor. In still another embodiment of the present invention, the dynamic variable speed compensator would comprise hardware in the form of an analog system. In this embodiment of the present invention, information would be supplied to the Compensator in the form of a DC voltage level or sine wave.

The current movement of the model train may be estimated to allow for the Compensator to understand whether the target speed has been attained/reached. The traditional method employed to measure motor speed involves using an encoder. An encoder takes the rotation of the motor and converts this information into a pulse wave. The time between one or more like edges of the pulse wave is measured to evaluate the speed. Another method employed to measure motor speed involves using a Hall effect sensor, wherein the Hall effect sensor is placed on the motor to encode the magnetic feedback of the motor. Still another method involves using a light strip on the head of the motor and using a single photosensor to read the light and dark stripes. The photosensor method may have the drawbacks of not having symmetry. An encoder with 24 pulses without symmetry receives 24 pieces of information in one rotation of the motor. An encoder with symmetry that has 24 pulses receives 48 pieces of information in one rotation of the motor. The drawback to achieving symmetry is that the amplifier on a transducer of the photosensor must be tuned for each particular engine.

To overcome this problem, according to an embodiment of the present invention, the motor is rotated at a constant speed and the distance between the rising and falling edge of pulse waves is measured and compared with the distance between the same falling and next rising edge. The amplifier on the transducer is then adjusted by the microprocessor until these two distances are the same. Allowing the microprocessor to automatically adjust for symmetry removes much of the cost associated with having a person manually adjust the system during manufacturing. Having more data per revolution is integral to a low ending operation and control of the train. In accordance with an embodiment of the present invention, a feedback system with greater than 60 pulses per revolution of the motor is necessary. With the addition of symmetry, the amount of data available per revolution may provide for improvements compared to current systems in the marketplace. Another improvement involves using dual sensors. The sensors are placed slightly offset of each other so that the pulses generated occur shifted 90 degrees from each other. With the addition of symmetry, the system is now able to receive 4 times the amount of information about the motor. A standard 24-pulse per revolution motor would have 96 pieces of information about the motor. A more exact method of evaluating a motor is to use a resolver. A resolver comprises a moving transformer that generates two signals. The first signal is a sine wave representing the current motor position, and the second signal is a cosine wave representing the current motor position. With these signals, the resolver is able to estimate with high accuracy (such as, but not limited to, 14 bit accuracy) the current position of the motor. This information is then sampled at a regular interval, and the speed of the motor revolution is calculated. In one embodiment of the present invention, an additional method of recovering the rotary and speed information of the motor may involve using three individual capacitors placed in an orientation allowing a calculation to be performed referring to the speed and position of the motor.

In accordance with an embodiment of the present invention, the dynamic variable speed compensator uses a modified version of a PID (proportional integral derivative) control loop to compensate forces that inhibit motor movement. Traditionally, the PID loop is used to precisely and accurately maintain constant motor speed. Other current methods of motor control strive to maintain a given speed at a given track voltage with little or no variation of speed. The control systems continuously monitor the rotation of the motor and adjust to maintain a speed with variation in as little as one revolution of the motor. In accordance with an embodiment of the present invention, the dynamic variable speed compensator uses a PID loop that is designed to allow the motor speed to vary. Traditionally, when a user would operate an engine in command or conventional mode without a closed loop motor control system, the user would have to manually adjust the speed of the engine to compensate for forces that inhibited the movement of the train (e.g., a steep incline or a large number of cars/heavy load). This is also indicative of real life operation of train engines. In a real life situation, the train operator must adjust the speed to compensate for varying conditions that the train may encounter. According to one embodiment of the present invention, a user/engineer controlling the model train cannot immediately compensate for the decrease or increase of speed associated with varying conditions. It should be appreciated that it takes time for the user to recognize that a change has occurred within the train system, wherein the user first evaluates a cause, makes adjustments, considers the results, and then ends the adjustment process or continues to make more adjustments. As a result, the model train of the present invention will slow down or speed up, for a period of time before the adjustments can be made to compensate. In addition, dynamic variable speed compensator causes the engine driving the model train to vary in RPMs without allowing the engine to completely stop. The dynamic variable speed compensator is made to mimic a real life interaction of cause and effect.

When no new target speed is being entered by the user, a command engine with speed control (e.g., a Lionel™ Odyssey engine or an MTH™ Proto2 engine) will maintain its commanded speed regardless of load, hills or other conditions. The present invention provides a dynamic variable speed compensator that allows the speed to realistically vary due to forces acting on the engine, and does not instantly correct the motor speed. The Compensator does not try to maintain a desired set or target speed, and is only activated when the microprocessor calculates that the actual speed deviates from the "target speed" by a factory or user preset percentage before gradually checking the decrease or increase in speed to hold the motor rotational speed from drifting further. As the forces acting on the motor subside, the train gradually returns to the "target speed" and maintains this speed until a new set of forces begins affecting the train speed again. The Compensator may be implemented in software and/or hardware in the remote control unit, Central Control Module, model train locomotive, or another part of the train system, and use digital and/or analog data transmission.

In one embodiment of the present invention, when the rotational speed of the motor moves below a predetermined threshold, such as 90% of the target speed, the Speed Compensator is activated and acts as a speed boost for the locomotive. The predetermined threshold may be selected by the user or automatically chosen by the system. The Speed Compensator has the ability of applying a different percentage of speed control/compensation. For example, if the current speed is at speed level 50, the Speed Compensator could be at 80%. If the motor is at speed level 10, then the Speed Compensator could be at 100%. Due to the Speed Compensator, a model train should not entirely stall at any time.

The above example can be referred to as "unreliable speed control" or a "dynamic variable speed compensator." As the model train slows to a lower speed level, this "unreliable speed control" is implemented. The present invention allows for a model train to have personality and varies the speed of the train, whereas conventional methods produce model trains with no struggles while a train is moving up a grade, no variation of speed of a train with a load, etc. This approach works to mimic the speed of a real train. The realistic slowing and gaining of speed in a model train, along with the respective sound and smoke effects associated with the slowing and gaining of speed may be maintained. The respective sound, smoke and light effects vary depending on the data provided by dynamic engine loading calculator 600.

Furthermore, one or more Dynacoupler™ force sensing module units could be used along with control system 306 to determine how the Speed Compensator is activated. In other words, a force sensing module could measure the force acting between two model train cars, and depending on the force between these cars, a signal for the Speed Compensator to be activated could be sent through a communication link to control system 306.

Additional embodiments of the present invention include allowing the Speed Compensator to send speed burst signals, where locomotive 202 performs short speed bursts. A user could also use the present invention to add a "turbo mode" to locomotive 202. Such capability provides a dynamic variable speed compensation of a model train system. This could involve using boost button 423 on remote control unit 400 to override the dynamic variable speed compensator and the dynamic engine loading calculator.

Future Events Generator

In yet another embodiment of the invention, the remote control 400 and/or the base/charger 450 can autonomously generate commands in order to cause train functions to occur without direct control by the operator. These train functions would be selected based on a variety of factors, including the current settings of the remote control unit, the type of train operating on the layout, the arrangement of accessories on the layout, location of the train within the layout, and the operator's pattern of historic use of the remote control 400 and/or the base/charger 450. From the user's perspective, these train functions would occur somewhat randomly and yet would be appropriate for the current operating conditions of the train. Hence, it would give the appearance that the train system is making decisions on its own as a participant in the train operation, rather than simply executing commands directed by the operator. This would significantly enhance the complexity and operator's enjoyment of the model train system.

The future event generator uses various input sources, including historical data and/or current remote control inputs, to determine and create future commanded events. These events can consist of a single event to any number of events separated by a future time stamp that allows for the correct playback or spacing of each future commanded event. The scaling of time can be introduced to allow a series of events to be compressed or expanded to fit into a given amount of time.

This allows a single store of events to be used for a variety of scenarios. There are numerous advantages of having the remote control or base/charger generate future events, rather than the locomotive perform preprogrammed sequences as is known in the art. First, the remote control and/or base/charger can introduce much greater variety of scenarios than the engine due to limited resources in the engine. Additionally, once the locomotive has been shipped from the factory it is very difficult to reprogram to add new functionality. Further, more than one device (i.e., model train or accessory) can be included in the scenario because of the way system distributes the commands. This can be used to create interaction and or dialog between two or more such devices.

By way of example, a commanded event could be as simple as detecting a special grade crossing by blowing the horn in a predetermined sequence of long, long, short and long blasts that provides a dialog that confirms the grade crossing event occurred. In a more complex event, if the operator is running a passenger train on the layout, the processor of the remote control 400 and/or base/charger 450 would select an algorithm to generate commands consistent with that type of train. In actual passenger trains, operational functions such as braking, accelerating/decelerating, coupling/uncoupling cars must be performed somewhat gently so as to avoid injury to the passengers, as opposed to a freight train in which the conductor is able to operate in a more abrupt manner. A passenger train would also tend to stop at every station and make appropriate announcements for the benefit of the passengers, such as "Now Approaching Fairmont Station." The train may also ring the bell or blow the horn in a unique manner as the train reaches each successive station. The algorithm selected by the processor may cause each of these events to occur without direct interaction by the operator. Moreover, by providing multiple algorithms for the processor from which to chose from, the train operation would change in a surprising and unpredictable manner while at the same time being consistent for the type of situation in which the train is operating. Further, if the operator has a tendency to operate the train in a particular manner, such as by frequently ringing the bell, applying the brake, or activating the smoke generator, the processor would recognize this and select accessories that would be consistent with the way the operator likes to run the train. It would be as if the operator had a virtual playmate that ran the train and made unique operational decisions.

Figures 10, 11:
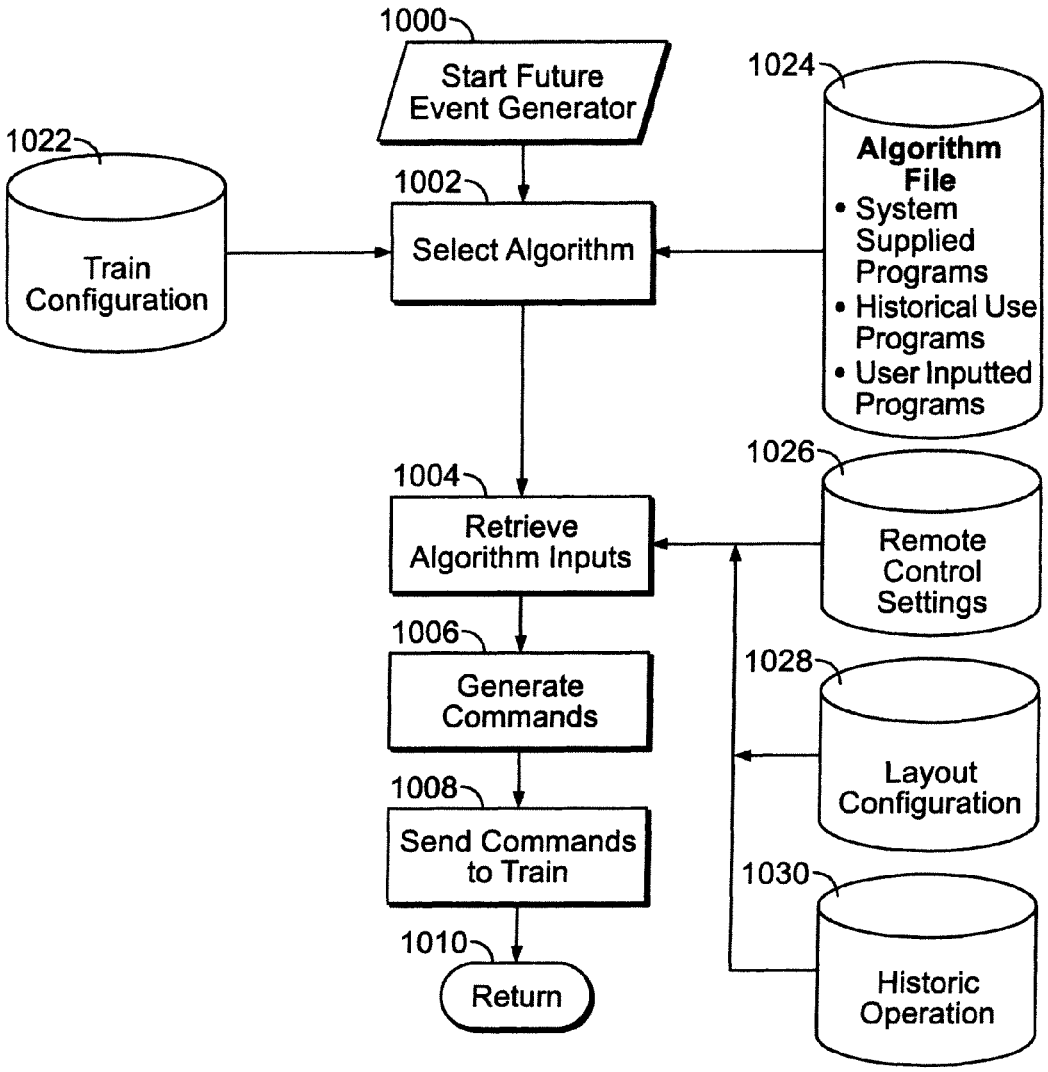
FIG. 10 is a flow chart illustrating an exemplary future events generator in accordance with an embodiment of the invention.
FIG. 11 illustrates a database of exemplary algorithms for execution by the future events generator of FIG. 10.

Referring to FIG. 10, a flow chart illustrates an exemplary implementation of a future events generator in accordance with the invention. It is anticipated that the future events generator be implemented as software code that is executed by the processor, though a hardware based implementation could also be utilized. The future events generator is initiated at step 1000 of the flow chart. Initiation of the future events generator could be selectively activated by the operator. Alternatively, could be activated autonomously by the remote control unit following a triggering event, e.g., elapsed amount of time of use of the model train, activation of an accessory, number of round trips of the model train around the layout, how the remote controller is being operated, the current setting of the of the various control inputs, etc. Further, the triggering event could be randomly selected from a number of possible triggering events, thereby further enhancing the surprising nature of the future events generator.

Once activated, the future events generator selects an appropriate algorithm at step 1002. A plurality of potential algorithms may be included in an algorithm file 1024 that is stored in memory coupled to the processor. Since the selected algorithm must be appropriate for the particular model train operating on the layout, step 1002 will also access a train configuration file 1022 that contains a description of the model train. This description may include parameters such as type of engine (e.g., diesel or steam engine), type of train (e.g., freight or passenger), number of cars, etc. The train configuration file 1022 may be populated automatically when the operator adds a train to the layout and it is recognized by the remote control unit. The contents of the algorithm file 1024 can be drawn from three different sources, including factory system programmed events, user inputted events, and historical data based on the way the user operated the system in the past.

The potential algorithms contained in the algorithm file 1024 may correspond to realistic scenarios that can be executed by the model train, such as making a stop at a station, delivering a freight car to a siding, sequentially activating lights along the length of the train, and the like. It should be appreciated that the number and variety of potential scenarios are endless. Each algorithm may produce a large number of individual commands that control functions such as speed, sound effects, smoke generation, coupling/uncoupling cars, etc., and that are generated and executed in a sequence so as to simulate a realistic, complex operational scenario. An exemplary algorithm file 1024 is shown in FIG. 11 as a table listing events by type and description. The event type may be used to classify events that could be used for the same type of train. For example, FIG. 11 includes three different events having the same event type (e.g., Pass Through Station, Deliver Freight Car to Siding, and Pick Up Freight Car From Siding). In step 1002, the future events generator may randomly select among the potential events appropriate for the particular model train. Groups of events of the same type may be collected together into a selection pool in which a random number is used to select an event in order to give the illusion of randomness in the event generation process.

As described above, the selected algorithm must be appropriate for the particular model train. There may be many potential algorithms for each type of train. The future events generator may select randomly among the potential algorithms. Alternatively, the operator could rank the potential algorithms in accordance with his preference, causing the future events generator to favor algorithms that would be most desired by the operator.

Once an appropriate algorithm has been selected, the future events generator will retrieve appropriate algorithm inputs at step 1004. The algorithm inputs may be retrieved from various files, such as a remote control settings file 1026, a layout configuration file 1028, and an historic operation file 1030. The remote control settings file 1026 includes the current configuration of the remote control unit, i.e., reflecting the position of all control inputs such as the throttle 410, the horn control slider 418, the brake-boost control 420, the train brake slider 422, and all other buttons and controls. The layout configuration file 1028 includes information regarding the model train layout, e.g., number and location of switches, hills, accessories, etc. This information may be collected using any of the various methods described above. The historic operation file 1030 includes a record of how the operator has used the model train in the past, e.g., frequency of use of accessories, such as smoke generator, sound effects, horn, bell, brake, etc. The inputs received from each of the foregoing files will determine the characteristics of the selected algorithm such as triggering events, types of effects to be produced, rate in which the scenario is to be performed, frequency of repeating the scenario, and the like.

At step 1006, the future events generator generates a series of commands in accordance with the selected algorithm and inputs. Depending upon the complexity of the selected algorithm, a particular scenario may include many individual commands (e.g., to change speed, to blow the horn, to activate lights, to produce smoke, to generate sound effects, etc.) At step 1008, these generated commands are communicated to the model train either in the form of a batch file that is executed by the microprocessor 316 contained within the model train, or alternatively, in series for execution in a sequence having timing defined by the remote control unit. The future events generator completes its execution at step 1010, whereupon the processor returns to the performance of other tasks and applications.

The number and variety of scenarios that may be produced by the future events generator can vary widely so that the operator rarely experiences the same scenario twice. In an exemplary scenario, an algorithm selected for a passenger train would be triggered by a feature included in the layout, such as an indicator affixed to a section of track. The indicator may be passive, such as an insulator interposed between track sections, or may be an active device that communicates a signal to the train as it passes. In either implementation, when the train detects the indicator, the sequence of commands produced by the future events generator may become active. The commands may have been generated and communicated to the train in advance. For example, the indicator may be positioned prior to a train station, causing the train to blow the horn in a desired pattern and begin reducing speed. Then, a conductor's voice would announce "NOW APPROACHING FAIRMONT STATION" through the sound unit in the train. The speed would continue to decrease, and other sound effects would be produced, such as the squeal of brakes. The train would enter the station and come to a complete stop, accompanied by appropriate sound effects such as more brake squealing and steam releasing. Lastly, animated movement within the train may become active, reflecting movement of passengers within the train. Sound effects corresponding to the movement of passengers would be produced. Lights in the station and on the train may turn on. The conductor's voice may announce "WELCOME TO FAIRMONT STATION-PLEASE EXIT THE TRAIN FROM THE LEFT."

In another exemplary scenario, an algorithm selected for a freight train would be triggered by the same indicator affixed to a section of track. Instead of bringing the train to a stop at the station, this algorithm might cause the freight train to reduce speed to a relatively slow rate while the train passes through the station. The reduction in speed might be accompanied by a series of horn blasts, such as with a first blast pattern as the train approaches the station vicinity and a second blast pattern as the train leaves the station vicinity. If the operator has a tendency to blow the horn in a particular pattern, the algorithm might recognize that prior use and repeat that pattern in one of the approaching or departing horn blasts. An increase in smoke volume may also accompany the increase in train speed. As the freight train passes through the station, the lights in locomotive may turn on and an animated conductor may wave to the train station. After passing the station, the train resumes its previous speed. The triggering event for this scenario might be determined by remote control settings detected by the future events generator. For example, the scenario might only be triggered if the operator has the throttle set at a relatively high speed.

Notably, these entire scenarios may occur without involvement or control by the operator. In fact, the scenarios may come as a total surprise to the operator, since it is planned and executed autonomously by the future events generator. Moreover, each time this scenario is repeated, it may be different, i.e., with slight variations to its execution, such as changing the sound effects, lighting control, announcements, train speed, etc., so that it always seems new, surprising and unique. It should be appreciated that the number and variety of possible scenarios would be endless. While it is anticipated that the scenarios be pre-programmed in the algorithm file 1024, it should also be appreciated that operators may be enabled to create their own scenarios that would be triggered autonomously by the future events generator.

It is further anticipated that the generated commands not only control train functions, but also control accessories and other aspects of the model train layout (e.g., switches, lights, bridges, etc.) This way, the scenarios can be further enhanced to encompass complex interactions between the model train and the layout. For example, a scenario might involve the model train being commanded to slow to a complete stop in front of a drawbridge, coupled with flashing warning lights and ultimately the raising of the drawbridge.

Velocity Control Throttle

As described above, the throttle dial 410 of FIGS. 4A and 4B enables the operator to directly control the train speed by rotating the dial clockwise to increase the train speed and counter-clockwise to decrease the train speed. The processor 540 within the remote control detects the position of the throttle dial 410 and calculates a target speed using the dynamic engine loading calculator. In an embodiment of the invention, the position of the throttle dial 410 as well as the angular velocity of the rotation of the throttle dial are used to calculate the target position. For example, if the operator rotates the throttle dial rapidly, the dynamic engine loading calculator may calculate a higher target speed than if the operator had rotated the throttle dial more slowly, even though the throttle dial was nevertheless turned to the same absolute position.

Velocity control over the throttle dial is desirable to address the growing need for higher resolution within the speed control range. Prior train control protocols known in the art offered only a limited number of discrete speed steps. This meant that train speed would change in increments corresponding to successive speed steps. This resulted in rough or jerky operation as the train transitioned from one speed step to another, which was particularly noticeable at relatively low speeds. The present invention enables a high number of discrete speed steps, with greater granularity between speeds so that transitions from one speed step to another appears more smooth. But, a drawback with the increased number of speed steps is that the throttle dial would have to be rotated through several complete resolutions in order to cover an entire range of possible speeds. By using the velocity of rotation of the throttle dial as a user input, the operator could quickly jump from one speed step to another, much higher, speed step without having to traverse a large angular range of the throttle dial. Even though the operator is enabled to select a desired speed very rapidly, it should be understood that the processor may not simply deliver that speed command to the model train right away. As described above, the velocity control enables the operator to rapidly input a target speed, but it is still up to the dynamic engine loading calculator and the dynamic variable speed compensator to determine the commanded speed.

Another application of the velocity control over the throttle dial is the fast selection or scrolling through menu systems based on the speed in which the dial has been turned. In this application, the throttle dial would be used as an alternative data entry device for selecting control variables other than speed. Yet another application of the velocity control over the throttle dial is the rapid entry of position information used to control accessories. This savings in time allows the operator to either input more details or control other devices while the current device is being controlled by the future effects generator.

Figure 12A:
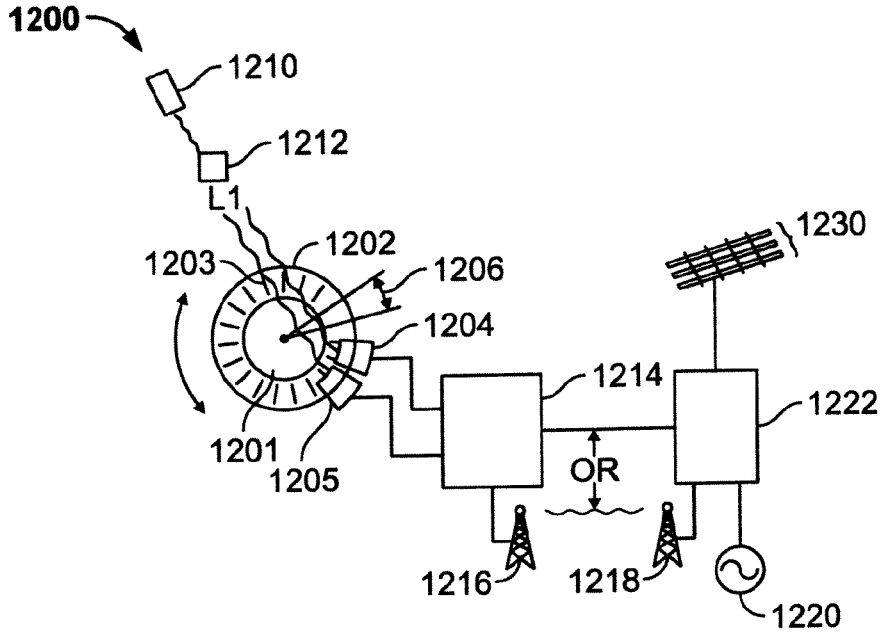
FIGS. 12A-12C illustrate an exemplary velocity control throttle knob for use in the model train controller of FIGS. 4A and 4B.
Figure 12B:
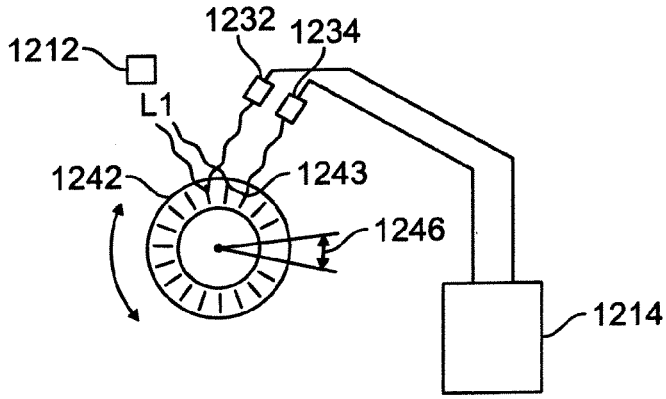
Figure 12C:
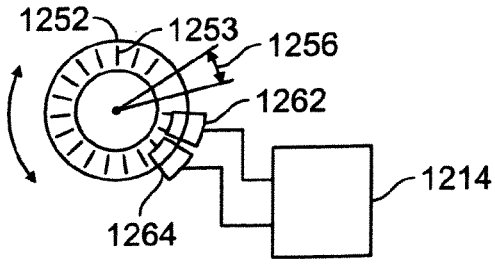

FIGS. 12A-12C are block diagrams illustrating an exemplary embodiment of a velocity control throttle adapted to detect absolute throttle position as well as rotational rate of the throttle. As shown in FIG. 12A, an alternating current power source 1220 is in electrical communication with rails 1230 through power regulator 1222. The power regulator 1222 is in turn in electrical communication with, and controlled by, processor 1214. The processor 1214 may be provided in the remote control (i.e., processor 540 of FIG. 5) or in the base unit (i.e., processor 610 of FIG. 6) as described above. The processor 1214 may communicate with the power regulator 1222 through a direct electrical connection, or alternatively via wireless signals, such as transmitted between antennas 1216 and 1218, as is generally known in the art.

The processor 1214 is adapted to receive inputs from a first optical detector 1204 and a second optical detector 1205. The throttle dial 410 of the remote control is in rotatable communication with a disk 1202 having a plurality of slots 1203. The slots 1203 extend in respective radial directions and are spaced circumferentially around the center of the disk 1202. Depending upon the rotational orientation of disk 1202, the slots 1203 are spaced to selectively permit light 1212 transmitted from a light source 1210 to reach one of detectors 1204 and 1205. Successful transmission of the light through a slot 1203 results in the respective optical detector 1204 and/or 1205 generating a corresponding voltage pulse that is communicated to the processor 1214. Optical detection is considered preferable over a mechanical implementation because the physical contact between a detector and the throttle dials is susceptible to vibrations, wear, and other effects that reduce accuracy of detection. Of course, for certain applications, mechanical detection may be an acceptable alternative.

In a conventional train control system, the processor 1214 receiving such an electronic pulse would change the power applied to the track based upon the number of pulses received from the optical detectors 1204, 1205. Alternatively, in a command train control system, the processor 1214 would use the electronic pulses to generate a target speed command, such using the dynamic engine loading calculator described above. Accordingly, in command train control applications, it should be understood that the processor 1214 would not control the power regulator 1222.

Figure 13A:
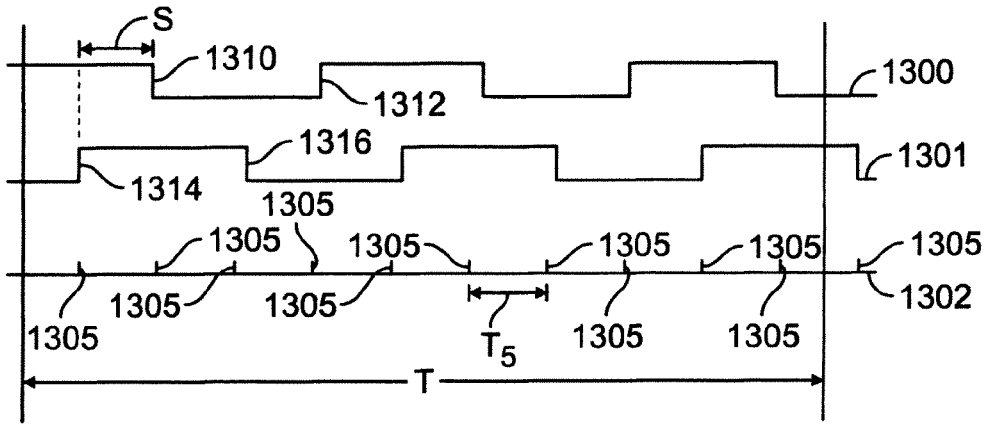
FIGS. 13A-13C illustrate exemplary waveforms produced by the velocity control knob of FIGS. 12A-12C.

FIG. 13A shows waveforms 1300 and 1301 of the electronic signals received by processor 1214 from the optical detectors 1204 and 1205, respectively, over a total time period T. Sample times 1305 along axis 1302 are generated on the rising edge 1312 or 1314 or the falling edge 1310 or 1316 of either wave 1300 and 1301. The optical detectors 1204 or 1205 generate an edge according to movement of the rotating wheel and disk over a predetermined angular distance, that allows the transmission of light through successive gaps. Waveforms 1300 and 1301 exhibit a 90° degree phase shift relative to each other. This phase shift allows the direction of turning of the wheel and disk to be recovered from the pulses transmitted from the detectors to the processor. An edge generates a signal for a single step velocity increase or decrease, based on the direction of rotation to the regulator, which is relayed to the model train. The velocity signal generated is limited to the number of edges comprising one complete revolution of the optical disk.

Figure 13B:
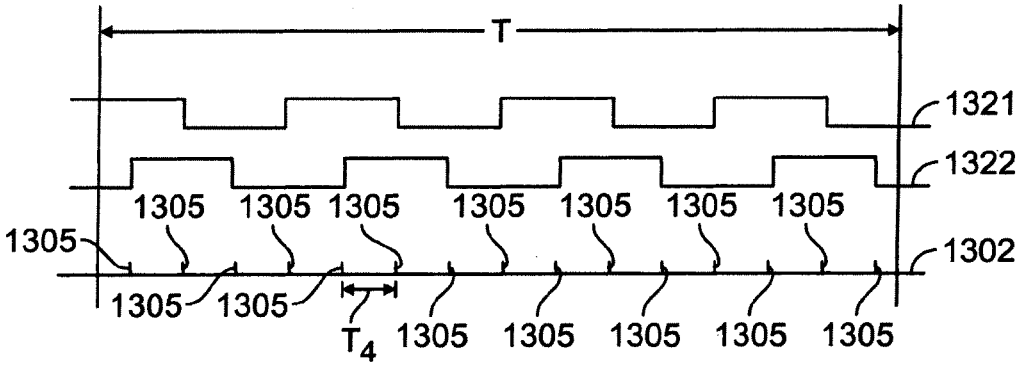

In order to provide for more fine-grained control over velocity control, it is possible to create an optical disk having more slots and therefore exhibiting a larger number of edges per revolution. Such a modified controller device, however, would exhibit a small angular distance between individual markings. This would cause difficulty in manipulating the device in order to accomplish a fine adjustment of train velocity. Conversely, where angular distance between slots is increased to avoid this problem, a user would be forced to rotate the wheel more than one revolution in order to complete the entire speed range. In order to adjust speed to the same velocity over the same time, a user would be forced to rotate the wheel and disk more rapidly. This is shown in FIG. 13B, which plots waveforms 1321 and 1322 of the electronic signals received by the processor from optical detectors 1204 and 1205, respectively. As compared with FIG. 13A, a larger number of sample times 1305 are received along axis 1302 over the same total time period T. It may also be desirable to include one or more detents that provide a tactile response to rotation of the throttle dial to thereby give the operator feedback as to the amount of control input being applied, without having to look at the physical rotation of the dial. Further, the detents may produce a slight sound by the rotation to indicate both the amount of movement and the speed in which the input is occurring. This allows the operator to remain focused on the engine or accessory being controlled.

As described above, control over velocity of a model train may be determined based upon the speed of rotation of a control throttle knob. Specifically, processor 1214 receives electronic pulses from optical detectors 1204 and 1205 that are in selective communication with optical source 1210 through gaps 1203 in an intervening optical disk 1202. The gaps 1203 in optical disk 1202 are regularly spaced in predetermined increments 1206 of angular distance. Processor 1214 receives the pulsed signals from optical detectors 1204 and 1205, calculating therefrom the amount of power ultimately conveyed to the model train. This velocity calculation is based not only upon the number of pulses received, but also upon the elapsed time between these pulses. The shorter the elapsed time between pulses, the greater the power communicated to the train.

Figure 13C:
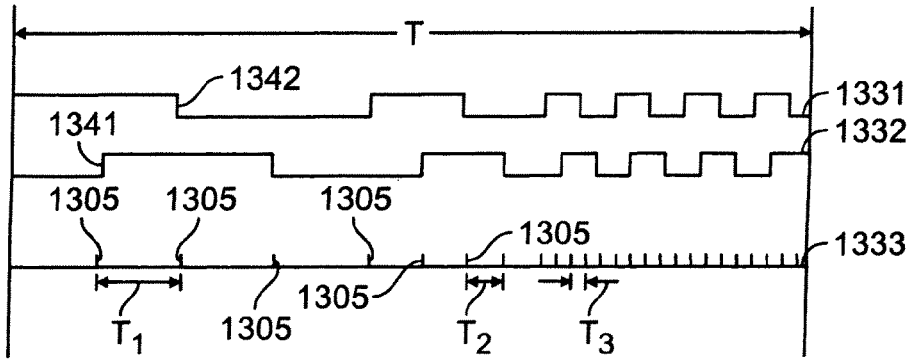

FIG. 13C plots waveforms 1331 and 1332 of the electronic signals received by processor 1214 from optical detectors 1204 and 1205, respectively, over a total time period T. Sample times 1305 along axis 1333 are generated on the rising edge 1341 or the falling edge 1342 of either wave 1331 and 1332. The optical detectors 1204 or 1205 generate a signal edge created by movement of the rotating wheel and disk over a predetermined angular distance.

Unlike the conventional approaches shown in FIGS. 13A and 13B, the number of pulses communicated to the processor 1214 do not necessarily correspond to single steps of velocity increase or decrease. Specifically, edges of the electrical pulses initially communicated from the detectors are spaced by a time interval $T_1$, and each edge corresponds to a single step change in velocity. Thus for time between edges of 1341, 1342, the resulting speed calculation would be performed utilizing an equation with one pulse multiplied by a speed factor of one, resulting in a speed generation change of one. In the above example the output generated when the interpretation of the movement is slow, or fine control is required.

Later during time T, however, the edges of the electrical pulses communicated from detectors 1204 and 1205 are spaced by a shorter time interval $T_2$ between edges. Processor 1214 receives these signals, and applies a multiplier factoring in knob speed, to in order produce the changed velocity. Thus, the correlation between pulse edges received and changes in velocity steps will exceed a 1:1 ratio for the time interval $T_2$. This time is shorter in duration, indicating the operator requires faster acceleration or deceleration of the train. The second example could evaluated as one pulse multiplied by a rotational speed factor of two, resulting in a change of two. This would allow the same number of slots to exist on the wheel, without requiring twice the movement.

Application of a multiplier to govern train velocity can occur over a range of control wheel rotation speeds. For example, in accordance with one embodiment of the present invention, rotation of the wheel at speeds corresponding to one full rotation in greater than 200 ms could result in a multiplication factor of one. Rotation of a full turn over a time of between about 100-200 ms could result in a multiplication factor of two, rotation of a full turn over a time of between about 50-100 ms could result in a multiplication factor of three, rotation of a full turn over a time of between about 25-50 ms could result in a multiplication factor of four, and rotation of a full turn over a time less than 25 ms could result in a multiplication factor of eight.

Still later during time T, the edges of the electrical pulses communicated from detectors 1204 and 1205 are spaced by an even shorter time interval $T_3$ between edges, in which T3<T2<T1. Processor 1214 receives these signals, and applies an even greater multiplier to produce the changed velocity. Thus, the correlation between pulse edges received and changes in velocity steps will exceed the ratio for the time interval $T_2$.

In a third example, times $T_2$ and $T_3$ could have a speed multiple factor of four and eight, respectively. Utilizing the former speed factor of four, a wheel conventionally generating fifty edges per revolution could produce one hundred speed step changes within a wheel rotational arc of only 180°, or two hundred speed step changes within a wheel rotational arc of 360°. Utilizing the latter speed factor of eight would require only one-half complete turn of the control throttle knob to complete the two hundred speed step command.

Initially, a user can rapidly rotate the knob to attain coarse control over a wide range of velocities, and then rotate the knob more slowly to achieve fine-grained control over the coarse velocity. Utilizing the control scheme in accordance with embodiments of the present invention, in a compact and uninterrupted physical motion, a user can rapidly exercise both coarse and fine control over velocity of a model train. It is important to note that velocity adjustment in accordance with the present invention is operable both to achieve both acceleration and deceleration of a moving train. Thus, movement of the control throttle knob in an opposite direction can rapidly and effectively reduce the amount of power provided to the locomotive, causing it to stop, and even accelerate in the reverse direction if necessary.

Although one specific embodiment has been described above, the present invention can be embodied in other specific ways without departing from the essential characteristics of the invention. Thus, while FIG. 12A shows a controller wherein electrical pulses indicating rotation of the control wheel are generated utilizing transmission of an optical beam through a gap, this is not required by the present invention. Alternative embodiments in accordance with the present invention could utilize other ways of generating electrical pulses based upon rotation of a control wheel knob. For example, rotation of a control knob over an angular distance could be detected through selective reflection, rather than transmission, of a light beam. In one such alternative embodiment shown in the simplified schematic drawing of FIG. 12B, a rotating disk 1242 could bear reflecting portions 1243 positioned at regular angular intervals 1246 on its surface. Optical detectors 1232 and 1234 could sense passage of the reflecting portion by detection of the reflected light beam.

It is anticipated that the velocity control throttle provide an input signal to the future events generator to enable the creation and execution of model train functions. In particular, the user's desire to accelerate or decelerate the train can provide an input that may trigger a future commanded event. For example, an operator may turn the velocity control throttle knob rapidly to indicate a desire to greatly increase the train speed. But, in this particular example, an immediate increase in train speed may not be appropriate because of various other conditions of the train or layout, or settings of the remote control. In one possible situation, the train is about to enter into a sharp curve (as known to the remote control due to received sensor signals), and the acceleration command could result in a derailment of the train. In another possible situation, the user has applied the train brake, which is inconsistent with the desire to accelerate the train. In yet another possible situation, the model train is a passenger train that should not accelerate so abruptly or their would be risk of injury to the passengers.

In each of these situations, the future events generator may use the velocity control throttle input to trigger the execution of an algorithm appropriate to the model train layout and configuration. The future events generator would recognize the operator's desire to increase the train speed (i.e., a desired end result) and would select an algorithm that would get the train to the desired end result in an appropriate manner. Instead of instantaneously accelerating the train, as would be done using conventional control protocols, the train may execute a series of commands that bring the train to the selected speed in a more controlled manner. For example, the train may issue an audible warning (e.g., a horn blast or announcement by the conductor), and begin the acceleration after a period of delay (e.g., after passing the sharp curve) or at a more gradual rate (e.g., appropriate for the type of train or the condition of the train brake). The speed commands issued to the train may be broken into a series of smaller speed changes that are executed over time. These speed commands could be sent to the train in a linear fashion equally spaced over time, or could be sent in a non-linear fashion that simulates the train engineer not wanting to overshoot a desired final speed. Both smoke and sound effects commands would be communicated at appropriate times to provide an orchestrated effect.

It should be appreciated that an entire, complex scenario would be performed by the train, involving very many individual commands generated and transmitted to the train, with only a single user input (e.g., rapidly turning the throttle dial). All of the individual commands were calculated by the remote control (and/or base/charger) without other user input. Moreover, the commands would be influenced by settings of the remote control (e.g., train brake, momentum, etc.) to further limit the final speed or rate of acceleration or type of sound/smoke effects produced.

While the above-referenced embodiments have disclosed the use of optical principles to generate electronic pulses correlating to movement of the disk, this is also not required by the present invention. In accordance with still other alternative embodiment shown in the simplified schematic drawing of FIG. 12C, electrical pulses could be generated as magnetic elements 1253 positioned at regular angular increments 1256 on a surface of a disk 1252 rotate past fixed magnetic sensors 1262 and 1264. Other embodiments utilizing mechanical contacts, such as mechanical rotary switches, could also be advantageously utilized for certain applications.

It will be understood that modifications and variations may be effected without departing from the scope of the novel concepts of the present invention. For example, individual systems described above can be integrated as one unit or separated into many parts based on, but not limited to, cost, function and location requirements. As used herein, a model train controller can be a wireless remote control, a base unit wired to the tracks, or any other controlling device. A train car can be a locomotive, a caboose, a boxcar, or any other part of a train. The base/charger, remote control, video monitor, computer interface, radio links, action recorder, macro recorder and all other aspects of the invention may be integrated into one device or separated into any number of individual devices containing any number of subsystems integrated together. Accordingly, the foregoing description is intended to be illustrative, but not limiting, of the scope of the invention which is set forth in the following claims.

What is claimed is:

1. A model train controller comprising:

a housing;

a plurality of control input devices coupled to the housing, the plurality of control input devices permitting user control over corresponding plural control features of the model train;

a touch screen display coupled to the housing and for displaying information concerning at least one of the plural control features of the model train and for receiving user selections regarding the at least one control feature;

a processor disposed within the housing and being operatively coupled to the plurality of control input devices and the touch screen display, the processor generating at least one model train command to be transmitted to the model train based at least in part on a user input received from either at least one of the plurality of control input devices or the touch screen display; and a transmitter for communicating the at least one model train command to the train;

wherein, the at least one model train command causes performance of at least one of said plural control features of said train in a manner corresponding to the received user input;

wherein the plurality of control input devices includes a linear slider biased in a neutral position, such that movement of the slider away from the neutral position in a first direction produces a first effect having a characteristic corresponding to the extent of movement in the first direction, and movement of the slider away from the neutral position in a second direction produces a second effect having a characteristic corresponding to the extent of movement in the second direction, wherein the first effect being different than the second effect.

2. The controller of claim 1, wherein the plurality of control input devices further includes a user throttle input for selecting a target speed for the model train, the processor determining a commanded speed based at least in part on the selected target speed, the at least one model train command including the commanded speed.

3. The controller of claim 2, wherein the plurality of control input devices further includes a momentum input for selecting a momentum level for the model train, the processor determining the commanded speed based on a selected momentum level for the train, the momentum level defining a rate in which the commanded speed is changed by the processor to match the target speed.

4. The controller of claim 2, wherein the plurality of control input devices further includes a brake input for selecting a braking level for the model train, the processor determining the commanded speed based on the braking level such that the commanded speed is reduced by an amount corresponding to the braking level.

5. The controller of claim 2, further comprising a graphic display for indicating both the target speed and the commanded speed.

6. The controller of claim 2, wherein the user throttle input further comprises a rotatable knob.

7. The controller of claim 6, wherein the processor detects the target speed based on at least one of rotational position of the knob and rotational speed of the knob.

8. The controller of claim 7, wherein the throttle input further comprises a disk operatively coupled to the knob, the disk including plural indicia spaced thereon, and a sensor oriented to detect the indicia as the disk rotates in cooperation with the knob.

9. The controller of claim 6, wherein the knob further permits user input in addition to target speed.

10. The controller of claim 2, wherein the processor further triggers generation of at least one effect in relation to a difference between the target speed and the commanded speed.

11. The controller of claim 10, wherein the at least one effect further comprises at least one of a sound effect, a smoke effect, and an action effect.

12. The controller of claim 1, wherein the touch screen display further comprises a keypad input for entering data and commands.

13. The controller of claim 1, wherein the touch screen display further comprises an LCD for detecting physical contact to register a keystroke.

14. The controller of claim 1, wherein the processor selectively displays icons on the touch screen display in connection with at least one of the plural control features of the model train.

15. A model train controller comprising:

a housing;

a plurality of control input devices coupled to the housing, the plurality of control input devices permitting user control over corresponding plural control features of the model train;

a touch screen display coupled to the housing and for displaying information concerning at least one of the plural control features of the model train and for receiving user selections regarding the at least one control feature;

a processor disposed within the housing and being operatively coupled to the plurality of control input devices and the touch screen display, the processor generating at least one model train command to be transmitted to the model train based at least in part on a user input received from either at least one of the plurality of control input devices or the touch screen display;

a transmitter for communicating the at least one model train command to the train; and a graphic display for indicating both a target speed and a commanded speed;

wherein, the at least one model train command causes performance of at least one of said plural control features of said train in a manner corresponding to the received user input;

wherein the plurality of control input devices includes a user throttle input for selecting the target speed for the model train, the processor determining the commanded speed based at least in part on the selected target speed, the at least one model train command including the commanded speed;

wherein the graphic display further illustrates the target speed as a line that is selectively moveable along a dimension of the graphic display in correspondence with changes of the user throttle input.

16. The controller of claim 15, wherein the graphic display further illustrates the commanded speed as a bar extending along the dimension of the graphic display by an amount corresponding to the commanded speed.

17. The controller of claim 16, wherein the bar has a contrasting shade with respect to a corresponding shade of the target line to facilitate distinguishing of relative positions of the target speed line and commanded speed bar.

18. A model train controller comprising:

a housing;

a plurality of control input devices coupled to the housing, the plurality of control input devices permitting user control over corresponding plural control features of the model train;

a touch screen display coupled to the housing and for displaying information concerning at least one of the plural control features of the model train and for receiving user selections regarding the at least one control feature;

a processor disposed within the housing and being operatively coupled to the plurality of control input devices and the touch screen display, the processor generating at least one model train command to be transmitted to the model train based at least in part on a user input received from either at least one of the plurality of control input devices or the touch screen display; and a transmitter for communicating the at least one model train command to the train:

wherein, the at least one model train command causes performance of at least one of said plural control features of said train in a manner corresponding to the received user input;

wherein the plurality of control input devices includes an effects input device for controlling production of at least one effect, the processor generating the at least one model train command to cause the model train to produce the at least one effect responsive to user operation of the effects input device;

wherein the effects input device further comprises a linear slider biased in a neutral position such that selective movement of the slider away from the neutral position produces the at least one effect having a characteristic corresponding to the extent of movement away from the neutral position;

wherein the neutral position is disposed substantially in a center of travel of the linear slider, and selective movement of the slider in a first direction away from the neutral position produces a first effect and selective movement of the slider in a second direction away from the neutral position produces a second effect different than the first effect.

19. The controller of claim 18, wherein the at least one effect further comprises at least one of a sound effect, a smoke effect, and an action effect.

20. The controller of claim 18, wherein the first effect comprises a first sound effect.

21. The controller of claim 18, wherein the at least one effect comprises a horn sound effect and the characteristic comprises intensity of the horn sound.

22. The controller of claim 18, wherein the at least one effect comprises at least one horn sound effect and the characteristic comprises number of distinctive horn sounds.

23. The controller of claim 18, wherein the at least one effect comprises at least one bell sound effect and the sound characteristic comprises number of distinctive bell sounds or intensity of the at least one bell sound.

24. A model train controller comprising:

a housing;

a sound effects input device coupled to the housing for controlling production by a model train of at least one sound effect, the sound effects input device providing plural distinct input signals in response to selective user actuation;

a processor disposed within the housing and being operatively coupled to the at least one sound effects input device to receiving the input signals therefrom, the processor generating at least one model train command to be transmitted to the model train based at least in part on the input signals, the at least one model train command causing the model train to produce the at least one sound effect having a characteristic responsive to the selective user actuation of the sound effects input device; and a transmitter for communicating the at least one model train command to the train;

wherein the sound effects input device further comprises a linear slider biased in a neutral position such that selective movement of the slider away from the neutral position produces the at least one sound effect having the characteristic corresponding to an extent of movement away from the neutral position;

wherein the neutral position is disposed substantially in a center of travel of the linear slider, and selective movement of the slider in a first direction away from the neutral position produces a first sound effect and selective movement of the slider in a second direction away from the neutral position produces a second sound effect different than the first sound effect.

25. The controller of claim 24, further comprising a second sound effects input device, wherein the second sound effects input device comprises a multi-position input switch.

26. The controller of claim 24, wherein the at least one sound effect comprises a horn sound effect and the characteristic comprises intensity of the horn sound.

27. The controller of claim 24, wherein the at least one sound effect comprises at least one horn sound effect and the characteristic comprises number of distinctive horn sounds.

28. The controller of claim 24, wherein the at least one sound effect comprises at least one bell sound effect and the sound characteristic comprises number of distinctive bell sounds or intensity of the at least one bell sound.

29. The controller of claim 24, further comprising a touch screen display coupled to the housing and for displaying information concerning at least one of plural control features of the model train and receive user selections regarding the at least one control feature.

30. The controller of claim 29, wherein the touch screen display further comprises a keypad input for entering data and commands.

31. The controller of claim 29, wherein the touch screen display further comprises an LCD for detecting physical contact to register a keystroke.

32. The controller of claim 31, wherein the touch screen display displays icons corresponding to operable features of the model train.

33. The controller of claim 31, wherein the touch screen display displays at least a first icon corresponding to a first operable feature of the model train during a first operating condition of the model train, and a second icon corresponding to a second operable feature of the model train during a second operating condition of the model train.

34. The controller of claim 33, wherein the first icon and the second icon are alternately displayed in a common region of the touch screen display during respective ones of the first and second operating conditions.

35. The controller of claim 24, further comprising a user throttle input device coupled to the housing and manipulated by a user to select a speed for the model train, the processor determining a commanded speed based on the selected speed, the at least one model train command including the commanded speed.

36. The controller of claim 35, wherein the user throttle input device is further manipulated by the user to select a target speed for the model train, the processor determining the commanded speed based at least in part on the selected target speed.

37. The controller of claim 36, further comprising a graphic display for indicating both the commanded speed and the target speed.

38. The controller of claim 35, further comprising a momentum input device coupled to the housing and manipulated by the user to select a momentum level for the model train, the processor determining the commanded speed based on a selected momentum level for the train, the momentum level defining a rate of change of the commanded speed.

39. The controller of claim 35, further comprising a brake input device coupled to the housing and manipulated by the user to select a braking level for the model train, the processor determining the commanded speed based on the braking level such that the commanded speed is reduced by an amount corresponding to the braking level.

40. The controller of claim 35, further comprising a graphic display for indicating the commanded speed.

41. The controller of claim 40, wherein the graphic display further illustrates the commanded speed as a bar extending along a dimension of the graphic display by an amount corresponding to the commanded speed.

42. A model train controller comprising:

a housing:

a sound effects input device coupled to the housing for controlling production by a model train of at least one sound effect, the sound effects input device providing plural distinct input signals in response to selective user actuation;

a processor disposed within the housing and being operatively coupled to the at least one sound effects input device to receiving the input signals therefrom, the processor generating at least one model train command to be transmitted to the model train based at least in part on the input signals, the at least one model train command causing the model train to produce the at least one sound effect having a characteristic responsive to the selective user actuation of the sound effects input device;

a transmitter for communicating the at least one model train command to the train;

a user throttle input device coupled to the housing and manipulated by a user to select a target speed for the model train, the processor determining a commanded speed based on the selected target speed, the at least one model train command including the commanded speed; and a graphic display for indicating both the commanded speed and a target speed;

wherein the graphic display further illustrates the commanded speed as a bar extending along a dimension of the graphic display field by an amount corresponding to the commanded speed and the target speed as a line that is selectively moveable along the bar in correspondence with changes of the user throttle input.

43. A model train controller comprising:

a housing;

a user throttle input device coupled to the housing and manipulated by a user to select a speed for the model train;

a brake input device coupled to the housing and manipulated by the user to select a braking effect for the model train;

a processor disposed within the housing and being operatively coupled to the user throttle input device and the brake input device, the processor generating at least one model train command to be transmitted to the model train based on settings of the user throttle input device and brake input device; and a transmitter for communicating the at least one model train command to the train;

wherein the brake input device further comprises a linear slider biased in a neutral position such that selective movement of the slider away from the neutral position produces a braking effect having a characteristic corresponding to an extent of movement away from the neutral position;

wherein the braking effect comprises a braking sound effect for a first portion of the extent of movement away from the neutral position, and a combination of the braking sound effect and a reduction in a commanded speed of the model train for a second portion of the extent of movement away from the neutral position.

44. The model train controller of claim 43, wherein the processor determines a commanded speed based on settings of at least one of the user throttle input device and the brake input device, the at least one model train command including the commanded speed.

45. The controller of claim 44, further comprising a graphic display for indicating the commanded speed.

46. The controller of claim 45, wherein the graphic display further illustrates the commanded speed as a bar extending along a dimension of the graphic display by an amount corresponding to the commanded speed.

47. The controller of claim 44, wherein the processor selects the commanded speed from among a plurality of discrete speed steps, and generates the at least one model train command in correspondence with a selected one of the speed steps.

48. The model train controller of claim 43, wherein the processor determines a sound effect based on settings of at least one of the user throttle input device and the brake input device, the at least one model train command including a sound effect command.

49. The controller of claim 43, wherein the user throttle input device is manipulated by the user to select a target speed for the model train, the processor determining the commanded speed by reducing the target speed by an amount corresponding to the brake input device setting.

50. The controller of claim 47, wherein the braking effect comprises a braking sound effect, and the characteristic comprises intensity of the braking sound effect.

51. The controller of claim 47, wherein the braking effect comprises a reduction in a commanded speed of the model train, and the characteristic comprises amount of speed reduction.

52. The controller of claim 43, further comprising a touch screen display coupled to the housing and for displaying information concerning at least one of plural control features of the model train and receive user selections regarding the at least one control feature.

53. The controller of claim 52, wherein the touch screen display further comprises a keypad input for entering data and commands.

54. The controller of claim 52, wherein the touch screen display further comprises an LCD for detecting physical contact to register a keystroke.

55. The controller of claim 43, further comprising a momentum input device coupled to the housing and manipulated by the user to select a momentum level for the model train, the processor determining a commanded speed based in part on a selected momentum level for the train, the momentum level defining a rate of change of the commanded speed, the at least one train command including the commanded speed.

56. The controller of claim 43, wherein the user throttle input further comprises a rotatable knob.

57. The controller of claim 43, wherein the neutral position is disposed substantially in a center of travel of the linear slider, and selective movement of the slider in a first direction away from the neutral position produces the braking effect and selective movement of the slider in a second direction away from the neutral position produces a speed boosting effect.

58. A model train controller comprising:

a housing;

a plurality of control input devices coupled to the housing, the plurality of control input devices permitting user control over corresponding plural control features of the model train;

a processor disposed within the housing and being operatively coupled to the plurality of control input devices, the processor generating a series of successive model train commands to be transmitted to the model train based at least in part on a single user input received from one of the plurality of control input devices; and a transmitter for communicating the successive model train commands to the train;

wherein, the series of successive model train commands causes performance of corresponding control features of said train;

wherein the plurality of control input devices includes a linear slider biased in a neutral position, such that movement of the slider away from the neutral position in a first direction produces a first effect having a characteristic corresponding to the extent of movement in the first direction, and movement of the slider away from the neutral position in a second direction produces a second effect having a characteristic corresponding to the extent of movement in the second direction, wherein the first effect being different than the second effect.

59. The controller of claim 58, wherein the plurality of control input devices further includes a user throttle input, the processor determining a commanded speed for the model train based at least in part on the user throttle input setting, at least one of the successive model train commands including the commanded speed.

60. The controller of claim 59, wherein the plurality of control input devices further includes a momentum input for selecting a momentum level for the model train, the processor determining the commanded speed based on a selected momentum level for the train, the momentum level defining a rate of change of the commanded speed.

61. The controller of claim 59, wherein the plurality of control input devices further includes a brake input for selecting a braking level for the model train, the processor determining the commanded speed based on the braking level such that the commanded speed is reduced by the processor over the successive model train commands by an amount corresponding to the braking level.

62. The controller of claim 59, further comprising a graphic display for indicating at least the commanded speed.

63. The controller of claim 62, wherein the graphic display further illustrates the commanded speed as a bar extending along a dimension of the graphic display by an amount corresponding to the commanded speed.

64. The controller of claim 59, wherein the user throttle input further comprises a rotatable knob.

65. The controller of claim 64, wherein the processor detects the user throttle input setting based on at least one of rotational position of the knob and rotational speed of the knob.

66. The controller of claim 65, wherein the throttle input further comprises a disk operatively coupled to the knob, the disk including plural indicia spaced thereon, and a sensor oriented to detect the indicia as the disk rotates in cooperation with the knob.

67. The controller of claim 64, wherein the knob further permits user input in addition to speed.

68. The controller of claim 58, wherein the plurality of control input devices further includes a user throttle input for selecting a target speed for the model train, the processor determining a commanded speed based at least in part on the selected target speed, at least one of the successive model train commands including the commanded speed.

69. The controller of claim 68, further comprising a graphic display for indicating both the commanded speed and the target speed.

70. The controller of claim 69, wherein the graphic display further illustrates the target speed as a vertical line that is selectively moveable along a dimension of the graphic display in correspondence with changes of the user throttle input.

71. The controller of claim 70, wherein the graphic display further illustrates the commanded speed as a bar extending along the dimension of the graphic display by an amount corresponding to the commanded speed.

72. The controller of claim 71, wherein the bar has a contrasting shade with respect to a corresponding shade of the target line to facilitate distinguishing of relative positions of the target speed line and commanded speed bar.

73. The controller of claim 58, further comprising a touch screen display coupled to the housing and for displaying information concerning at least one of the plural control features of the model train and receive user selections regarding the at least one control feature.

74. The controller of claim 73, wherein the touch screen display further comprises a keypad input for entering data and commands.

75. The controller of claim 73, wherein the touch screen display further comprises an LCD for detecting physical contact to register a keystroke.

76. The controller of claim 73, wherein the processor selectively displays icons on the touch screen display in connection with at least one of the plural control features of the model train.

77. The controller of claim 58, wherein at least one of the successive model train commands causes the model train to produce at least one effect in response to a difference between the target speed and the commanded speed.

78. The controller of claim 77, wherein the at least one effect further comprises at least one of a sound effect, a smoke effect, and an action effect.

79. A model train controller comprising:

a housing;

a plurality of control input devices coupled to the housing, the plurality of control input devices permitting user control over corresponding plural control features of the model train;

a processor disposed within the housing and being operatively coupled to the plurality of control input devices, the processor generating a series of successive model train commands to be transmitted to the model train based at least in part on a single user input received from one of the plurality of control input devices; and a transmitter for communicating the successive model train commands to the train;

wherein, the series of successive model train commands causes performance of corresponding control features of said train;

wherein the plurality of control input devices includes an effects input device for controlling production of at least one effect, at least one of the successive model train commands causing the model train to produce the at least one effect;

wherein the effects input device further comprises a linear slider biased in a neutral position such that selective movement of the slider away from the neutral position produces the at least one effect having a characteristic corresponding to the extent of movement away from the neutral position;

wherein selective movement of the slider in a first direction away from the neutral position produces a first effect and selective movement of the slider in a second direction away from the neutral position produces a second effect different than the first effect.

80. The controller of claim 79, wherein the at least one effect further comprises at least one of a sound effect, a smoke effect, and an action effect.

81. The controller of claim 79, wherein the first effect comprises a first sound effect and the second effect comprises a second sound effect.

82. The controller of claim 79, wherein the at least one effect comprises a horn sound effect and the characteristic comprises intensity of the horn sound.

83. The controller of claim 79, wherein the at least one effect comprises at least one bell sound effect and the sound characteristic comprises number of distinctive bell sounds or intensity of the at least one bell sound.

84. A model train controller comprising:

a housing;

a plurality of control input devices coupled to the housing, the plurality of control input devices permitting user control over corresponding plural control features of the model train;

a processor disposed within the housing and being operatively coupled to the plurality of control input devices, the processor generating a series of successive model train commands to be transmitted to the model train based at least in part on a single user input received from one of the plurality of control input devices; and a transmitter for communicating the successive model train commands to the train;

wherein, the series of successive model train commands causes performance of corresponding control features of said train;

wherein the plurality of control input devices includes an effects input device for controlling production of at least one effect, at least one of the successive model train commands causing the model train to produce the at least one effect;

wherein the effects input device further comprises a linear slider biased in a neutral position such that selective movement of the slider away from the neutral position produces the at least one effect having a characteristic corresponding to the extent of movement away from the neutral position;

wherein the at least one effect comprises at least one horn sound effect and the characteristic comprises number of distinctive horn sounds.

85. A model train controller comprising:

a housing;

a touch screen display coupled to the housing and for displaying icons corresponding to operable features of a model train layout;

at least one user input device coupled to the housing and permitting user control over the operable features of the model train layout;

a processor disposed within the housing and operably coupled to the touch screen display and the at least one user input device, the processor generating at least one digital command based on user settings of the at least one user input device and user selections on the touch screen display; and a transmitter for communicating the at least one digital command to the operable features of a model train layout;

wherein the at least one user input device includes a linear slider biased in a neutral position, such that movement of the slider away from the neutral position in a first direction produces a first effect having a characteristic corresponding to the extent of movement in the first direction, and movement of the slider away from the neutral position in a second direction produces a second effect having a characteristic corresponding to the extent of movement in the second direction, wherein the first effect being different than the second effect.

86. The controller of claim 85, wherein a first icon corresponding to a first operable feature of the model train layout is displayed in a first location of the touch screen display upon a first user setting of the at least one user input device or a first user selection on the touch screen display.

87. The controller of claim 86, wherein a second icon corresponding to a second operable feature of the model train is displayed in the first location of the touch screen display upon a second user setting of the at least one user input device or a second user selection on the touch screen display.

88. The controller of claim 86, wherein a second icon corresponding to a second operable feature of the model train is displayed in a second location of the touch screen display upon a second user setting of the at least one user input device or a second user selection on the touch screen display.

89. The controller of claim 86, wherein the processor generates a first digital command upon a first user setting of the at least one user input device or a first user selection on the touch screen display.

90. The controller of claim 89, wherein the processor generates a second digital command upon a second user setting of the at least one user input device or a second user selection on the touch screen display.

* * * * *